US011282443B2

(12) United States Patent
Kawae et al.

(10) Patent No.: US 11,282,443 B2
(45) Date of Patent: Mar. 22, 2022

(54) DISPLAY APPARATUS

(71) Applicant: SAMSUNG ELECTRONICS CO., LTD., Suwon-si (KR)

(72) Inventors: Daisuke Kawae, Yokohama (JP); Junichi Yamashita, Yokohama (JP); Takashige Fujimori, Yokohama (JP)

(73) Assignee: SAMSUNG ELECTRONICS CO.. LTD., Suwon-si (KR)

( * ) Notice: Subject to any disclaimer, the term of this patent is extended or adjusted under 35 U.S.C. 154(b) by 0 days.

(21) Appl. No.: 17/103,484

(22) Filed: Nov. 24, 2020

(65) Prior Publication Data

US 2021/0158748 A1 May 27, 2021

(30) Foreign Application Priority Data

Nov. 25, 2019 (JP) ..... JP2019-212074
Nov. 26, 2019 (JP) ..... JP2019-213308
Oct. 22, 2020 (KR) ..... 10-2020-0137470

(51) Int. Cl.
*G09G 3/32* (2016.01)

(52) U.S. Cl.
CPC ..... *G09G 3/32* (2013.01); *G09G 2310/0291* (2013.01); *G09G 2310/08* (2013.01)

(58) Field of Classification Search
CPC ..... G09G 2310/0291; G09G 3/32; G09G 2300/0819; G09G 2310/08; G09G 2300/0861; G09G 2300/0852; G09G 2300/0833; G09G 3/2011; G09G 3/2014
See application file for complete search history.

(56) References Cited

U.S. PATENT DOCUMENTS 7,903,057 B2 * 3/2011 Uchino ..... G09G 3/3233 345/77
10,490,128 B1 * 11/2019 Qian ..... G09G 3/3233
2009/0167647 A1 * 7/2009 Yamamoto ..... G09G 3/3266 345/76

(Continued)

FOREIGN PATENT DOCUMENTS

JP 2004126168 A 4/2004
JP 2010093365 A 4/2010

(Continued)

OTHER PUBLICATIONS

International Search Report (PCT/ISA/210) dated Mar. 2, 2021 issued by the International Searching Authority in International Application No. PCT/KR2020/016260.

*Primary Examiner* — Muhammad N Edun
(74) *Attorney, Agent, or Firm* — Sughrue Mion, PLLC

(57) ABSTRACT

A display apparatus includes a light emitting element; and a pixel circuit configured to drive the light emitting element. The pixel circuit may include a first capacitor configured to output a first voltage corresponding to an image signal; a first transistor having a control terminal connected to the first capacitor and to which the first voltage is applied, a first terminal to which a second voltage corresponding to a slope signal that changes over time is applied, and a second terminal configured to output an output signal based on a comparison between the first voltage and the second voltage; and a driving circuit configured to drive the light emitting element based on the output signal of the second terminal.

17 Claims, 32 Drawing Sheets

(56) References Cited

U.S. PATENT DOCUMENTS

| | | | |
|---|---|---|---|
| 2011/0084987 | A1 | 4/2011 | Kim et al. |
| 2013/0082906 | A1 | 4/2013 | Toyomura et al. |

FOREIGN PATENT DOCUMENTS

| | | | |
|---|---|---|---|
| JP | 2014150482 | A | 8/2014 |
| KR | 1020110035443 | A | 4/2011 |
| KR | 101942466 | B1 | 4/2019 |

* cited by examiner

DISPLAY APPARATUS

CROSS-REFERENCE TO RELATED APPLICATION(S)

This application is based on and claims priority under 35 U.S.C. § 119 to Japanese Patent Application No. 2019-212074, filed on Nov. 25, 2019, Japanese Patent Application No. 2019-213308, filed on Nov. 26, 2019, and Korean Patent Application No. 10-2020-0137470, filed on Oct. 22, 2020, the disclosures of which are incorporated by reference herein in their entirety.

BACKGROUND

1. Field

The disclosure relates to a display apparatus, and more particularly, to a display apparatus including a micro light emitting diode.

2. Description of Related Art

Recently, development of a display apparatus in which a micro light emitting diode (LED) is mounted in a two-dimensional matrix form has been actively developing. This is because the display apparatus using the micro LED (hereinafter referred to as a "micro LED display") has advantages such as having a higher contrast ratio than a display apparatus using a liquid crystal element and less deterioration than a display apparatus using an organic light emitting diode (OLED).

In the case of the micro LED display, it may have the same or similar benefits as other display apparatuses that perform active matrixing. As one of the methods of expressing gradations in such display apparatus, there is a gradation expression method that combines constant current driving of a light emitting element and control of a light emission time by pulse width modulation (PWM). In general, in this drive, a transistor serving as a switch is provided in a pixel circuit, and two states of light emission and non-emission are realized by controlling the switch to turn on or off, and the gradation is expressed by controlling the light emission time at a temporal ratio of the two states. Since the current driving the light emitting element is constant, that is, an operating point of the light emitting element is constant, there is an advantage in that color shift is difficult to occur.

In the PWM gradation control, there may be a method of discretely controlling the light emission time by obtaining sub-frame groups and combining the sub-frame groups, and a method of continuously controlling the light emission time using a clamp type inverter and a slope signal. Compared to the former method, the latter method may be advantageous in that a perception phenomenon called pseudo contour does not occur in principle.

However, the method of controlling the PWM gradation using the clamp type inverter and the slope signal is known. In addition, in the related art, there is a problem that a dynamic range of light emission is limited by the clamp type inverter.

In addition, in order to prevent activation periods of various pulse signals from overlapping, a new pulse signal that controls an interval between each pulse signal may be input or output. However, in this case, the number of input/output signals (I/O signals) for the new pulse signal may increase. Therefore, it may increase the circuit scale of the display apparatus.

SUMMARY

Provided is a method of controlling PWM gradation using a clamp type inverter and a slope signal that does not limit a dynamic range of light emission.

Also provided are a pulse generator and a display apparatus capable of suppressing an increase in circuit scale and preventing activation periods of a plurality of digital pulse signals from overlapping.

Additional aspects of the disclosure will be set forth in part in the description which follows and, in part, will be apparent from the description, or may be learned by practice of the presented embodiments.

In accordance with an aspect of the disclosure, there is provided a display apparatus including: a light emitting element; and a pixel circuit configured to drive the light emitting element, and including: a first capacitor configured to output a first voltage corresponding to an image signal; a first transistor having a control terminal connected to the first capacitor and to which the first voltage is applied, a first terminal to which a second voltage corresponding to a slope signal that changes over time is applied, and a second terminal configured to output an output signal based on a comparison between the first voltage and the second voltage; and a driving circuit configured to drive the light emitting element based on the output signal of the second terminal.

The pixel circuit further includes an amplifier configured to amplify the output signal of the second terminal; and the driving circuit is further configured to turn on or off the light emitting element based on the output signal amplified by the amplifier.

The amplifier is configured to make an output terminal configured to carry the output signal of the amplifier into a high impedance based on a third voltage of the output signal of the first transistor being less than a first threshold, and to amplify the third voltage of the output signal of the first transistor based on the third voltage of the output signal of the first transistor being greater than a second threshold.

The amplifier is configured to invert and amplify the output signal of the first transistor.

The driving circuit includes a second transistor configured to supply a constant current to the light emitting element and a second capacitor connected to a control terminal of the second transistor; and the second capacitor is configured to be charged with a reference voltage so that the second transistor supplies the constant current.

Based on the first voltage being less than the second voltage, the second capacitor is configured to output the reference voltage and the second transistor is configured to supply the constant current to the light emitting element; and based on the first voltage being greater than the second voltage, the second capacitor is configured to be discharged and the second transistor is configured to be turned off.

The pixel circuit further includes a first switch provided between the control terminal of the first transistor and the second terminal of the first transistor, and configured to control the first switch to connect or disconnect the control terminal and the second terminal.

Based on the first switch being turned on to connect the control terminal and the second terminal, the image signal input through the first terminal of the first transistor is provided to the first capacitor through the first transistor.

The pixel circuit further includes a second switch provided between the second terminal of the first transistor and an external power terminal.

The output signal output through the second terminal of the first transistor is initialized based on the second switch being turned on to connect the second terminal of the first transistor and the external power terminal.

The display apparatus further includes: a pulse generator configured to control the first switch and the second switch based on a reset signal and a clock signal.

The pulse generator includes: a synchronous circuit including a sequential circuit driven by the clock signal, and configured to output a plurality of output signals from the sequential circuit; and a gating circuit configured to generate a plurality of pulse signals by gating the plurality of output signals output from the synchronous circuit, and the gating circuit is configured to deactivate each of the pulse signals in a high state period of the clock signal.

The each of the pulse signals is configured to be activated by the gating circuit in a low state period of one of the clock signals.

The sequential circuit includes: a state machine configured to receive the clock signal; and a decoder configured to output the plurality of output signals based on state signals output from the state machine.

The gating circuit includes: an inverter configured to output an inverted signal of the clock signal; and a plurality of AND gates configured to output the plurality of pulse signals, respectively, where each of the plurality of pulse signals includes a logical product of each of the plurality of output signals output from the decoder and the inverted signal output from the inverter.

The pixel circuit and the pulse generator are integrated into a micro IC.

The micro IC includes three or less data input terminals.

The three or less data input terminals includes: a first data input terminal configured to receive the image signal and the slope signal; a second data input terminal configured to receive the reset signal; and a third data input terminal configured to receive the clock signal.

BRIEF DESCRIPTION OF THE DRAWINGS

The above and other aspects, features, and advantages of certain embodiments of the disclosure will become more apparent from the following description taken in conjunction with the accompanying drawings, in which.

DETAILED DESCRIPTION

Figure 1:
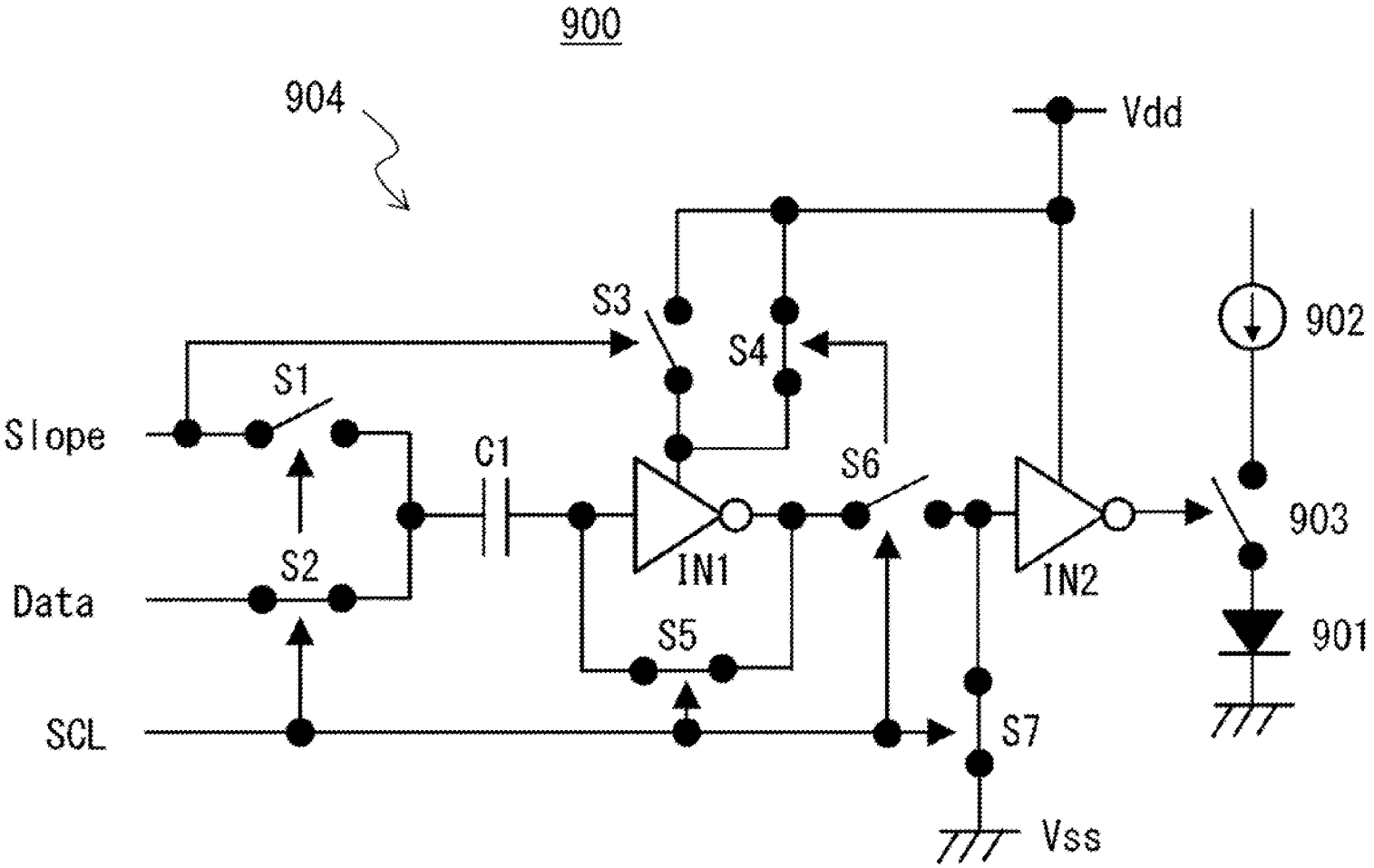
FIG. 1 is a circuit diagram illustrating a configuration of a pixel circuit according to a related art.

Like reference numerals may refer to like elements throughout the disclosure. Not all elements of the embodiments of the disclosure will be described, and the description of what are commonly known in the art or what overlap each other in the embodiments will be omitted. The terms as used throughout the disclosure, such as "~part," "~module," "~member," "~block," etc., may be implemented in software and/or hardware, and a plurality of "~parts," "~modules," "~members," or "~blocks" may be implemented in a single element, or a single "~part," "~module," "~member," or "~block" may include a plurality of elements.

It will be further understood that the term "connect" and its derivatives refer both to direct and indirect connection, and the indirect connection includes a connection over a wireless communication network.

The terms "include (or including)" and "comprise (or comprising)" are inclusive or open-ended and do not exclude additional elements or steps, unless otherwise indicated. It will be further understood that the term "member" and its derivatives refer both to when a member is in contact with another member and when another member exists between the two members.

Further, when it is stated that a layer is "on" another layer or substrate, the layer may be directly on another layer or substrate or a third layer may be disposed therebetween.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another element, region, layer or section.

It is to be understood that the singular forms "a," "an," and "the" include plural forms unless the context clearly indicates otherwise.

Reference numerals used for method steps are merely used for convenience of explanation, but not to limit an order of the steps. Thus, unless the context clearly indicates otherwise, the order of the steps are not limited to specific embodiments described herein.

Hereinafter, the operation principles and embodiments of the disclosure will be described with reference to the accompanying drawings.

Figure 2:
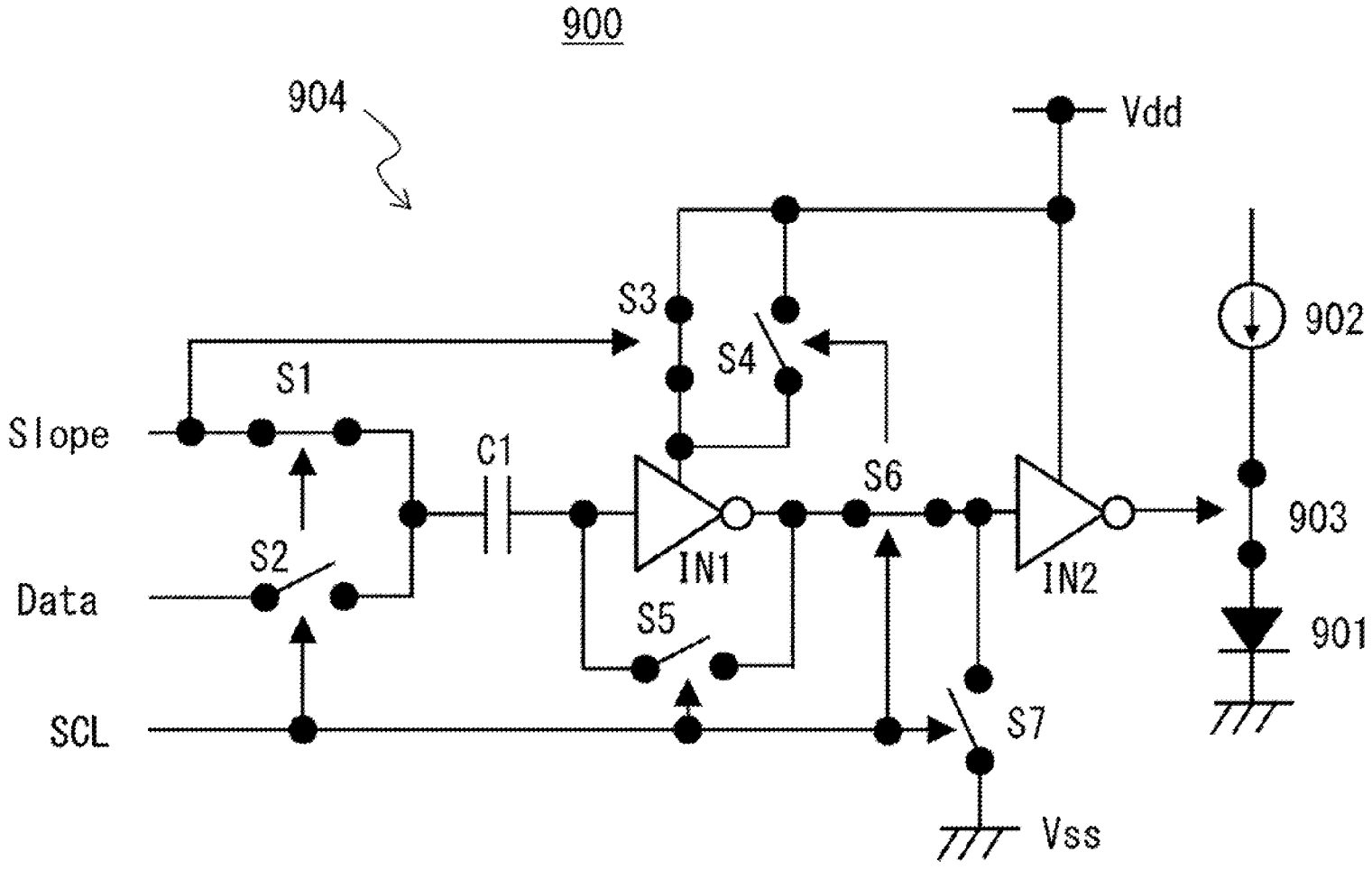
FIG. 2 is a circuit diagram illustrating a configuration of a pixel circuit according to a related art.

FIGS. 1 and 2 are circuit diagrams illustrating configuration examples of a pixel circuit according to a related art.

A pixel circuit 900 is a circuit that continuously controls a light emission time using a clamp type inverter and a slope signal. FIG. 1 illustrates a state when programming the pixel circuit 900 (i.e., when a data signal is input), and FIG. 2 illustrates a state when the pixel circuit 900 is driven.

Referring to FIGS. 1 and 2, the pixel circuit 900 may include a light emitting element 901, a constant current source 902 for supplying a constant current to the light emitting element 901, a driving switch 903 connected between the light emitting element 901 and the constant current source 902, and a pulse width modulation (PWM) circuit 904 for controlling on/off of the driving switch 903.

The PWM circuit 904 may include a capacitor C1, inverters IN1 and IN2, and switches S1 to S7. The slope signal is input to an input terminal of the capacitor C1 through the switch S1, and a data signal (image signal) is input to the input terminal of the capacitor C1 through the switch S2. During programming of FIG. 1, the switch S1 is turned off by a control signal SCL, the switch S2 is turned on, and the data signal is input to the capacitor C1. During the driving of FIG. 2, the switch S1 is turned on and the switch S2 is turned off by the control signal SCL, and the slope signal is input to the capacitor C1. Then, the inverter IN1 (clamp type inverter) may output a signal according to the comparison of the data signal and the slope signal, and the driving switch 903 may be controlled by the PWM signal output through the inverter IN2. Accordingly, the light emission time of the light emitting element 901 is controlled according to the comparison of the data signal and the slope signal.

However, there are problems in the related art in that, since the pixel circuit 900 in the related art superimposes the image signal and the slope signal through capacitor coupling (capacitor C1), the dynamic range of the image signal is substantially limited by an internal pressure of the circuit elements constituting the clamp type inverter. In addition, in order to secure the dynamic range, a high-voltage element must be employed, and an increase in manufacturing cost cannot be avoided. This case will be described in more detail.

A high side of a power potential supplied to the clamp type inverter is called Vdd, and a low side is called Vss. At this time, from the viewpoint of the internal pressure of the element, the potential that can be applied to the input terminal of the clamp type inverter is limited to Vss or more and Vdd or less (here, for convenience, power supply voltage=element internal pressure). When the potential applied to the input terminal reaches a maximum value, it is a timing at which the potential of the image signal reaches a minimum value and the potential of the slope signal reaches the maximum value. Likewise, when the potential applied to the input terminal reaches the minimum value, it is a timing at which the potential of the image signal reaches the maximum value and the potential of the slope signal reaches the minimum value. Here, if a voltage amplitude of the image signal is ΔVsig and a voltage amplitude of the slope signal is ΔVslope, it is necessary to satisfy the following Equation (1).

$$Vdd-Vss>\Delta Vsig+\Delta Vslope \quad (1)$$

In Equation (1), the left side of the equation represents the internal pressure and the right side represents the amplitude of the potential that can appear at the input terminal of the clamp type inverter. As a signal setup, ideally, it should be ΔVsig=ΔVslope, so the voltage amplitude of the image signal is limited to (Vdd−Vss)/2. In more detail, a logic threshold value of the clamp type inverter is also a factor that limits the voltage amplitude of the image signal, but may be omitted here.

Although the above explanation only describes the input potential of the clamp type inverter, not the dynamic range of the image signal, it is not practical to expand the dynamic range of the image signal by reducing a coupling capacitor. Also, the constraint on the input potential of the clamp type inverter does not change. The operation of the clamp type inverter is an important factor in determining the precision of PWM control, and by expanding the dynamic range of the input potential of the clamp type inverter is essential for improving the precision.

According to the embodiments of the disclosure, the dynamic range is expanded without overlapping the input of the image signal and the slope signal, which was one of the problems in the related art.

Figure 3:
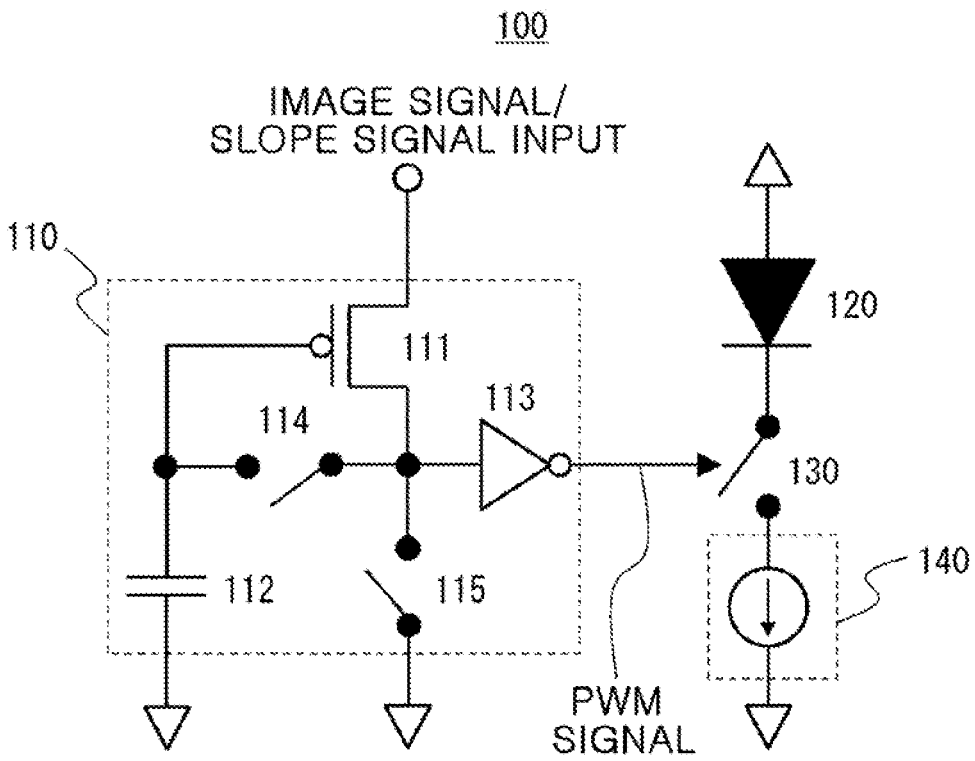
FIG. 3 is a circuit diagram illustrating a pixel circuit according to an embodiment.

FIG. 3 is a circuit diagram illustrating a pixel circuit according to an embodiment. As illustrated in FIG. 3, the pixel circuit 100 according to the embodiment may include a light emitting element 120, a driving switch 130, a constant current setting device 140, and a PWM controller 110. The constant current setting device 140 is a constant current source that drives the constant current flowing through the light emitting element 120 and the driving switch 130. In this case, the driving switch 130 may be included in the constant current setting device 140. For example, the constant current setting device 140 and the driving switch 130 may be a driving circuit that drive the light emitting element 120 according to a PWM signal output from the PWM controller 110.

The PWM controller 110 may control the light emission time of the light emitting element 120 by generating the PWM signal based on the image signal and the slope signal. In this example, the PWM controller 110 may control on/off of the driving switch 130 based on the comparison result of the image signal and the slope signal. The PWM controller 110 may include a metal oxide semiconductor (MOS) transistor 111, a capacitor 112, an amplifier 113, and switches 114 and 115.

The MOS transistor (gradation control transistor) 111 is an example of a transistor and is, for example, a P-type MOS transistor. In the MOS transistor 111, the image signal/slope signal is input to a source (first terminal). A gate (control terminal) is connected to one end of the capacitor 112, and a drain (second terminal) is connected to the input terminal of the amplifier 113. The other end of the capacitor 112 is connected to a power source Vss, which is an example of a fixed power source. The switch 114 is connected between the gate and the drain of the MOS transistor 111 so that the MOS transistor 111 is diode-connected.

The capacitor 112 may maintain the potential of the image signal input to the source while the MOS transistor 111 is diode-connected. The MOS transistor 111 may compare a level of the maintained image signal of the gate and the slope signal input to the source, and output a comparison result (PWM signal) from the drain. The on/off state of the MOS transistor 111 may be switched according to the relative change of magnitude between the image signal and the slope signal.

The switch 115 may be connected between the drain of the MOS transistor 111 and the power supply Vss to initialize the drain of the MOS transistor 111. The output terminal of the amplifier 113 may be connected to the control terminal of the driving switch 130. The constant current setting device 140 and the driving switch 130 may drive the light emitting element 120 according to the output of the amplifier 113.

In this embodiment, the MOS transistor 111 may compare the image signal input to the gate (the image signal input through the source terminal and maintained at the gate) with the slope signal input to the source, and output the comparison result from the drain. In addition, the constant current setting device 140 and the driving switch 130 may control light emission of the light emitting element 120 based on the comparison result. Therefore, since there is no need to overlap the input of the image signal and the slope signal like in the related art, the dynamic range of the image signal may be expanded.

Hereinafter, the display apparatus including the pixel circuit, and the configuration and operation of the pixel circuit will be described.

<Configuration of Display Apparatus>

Figure 4:
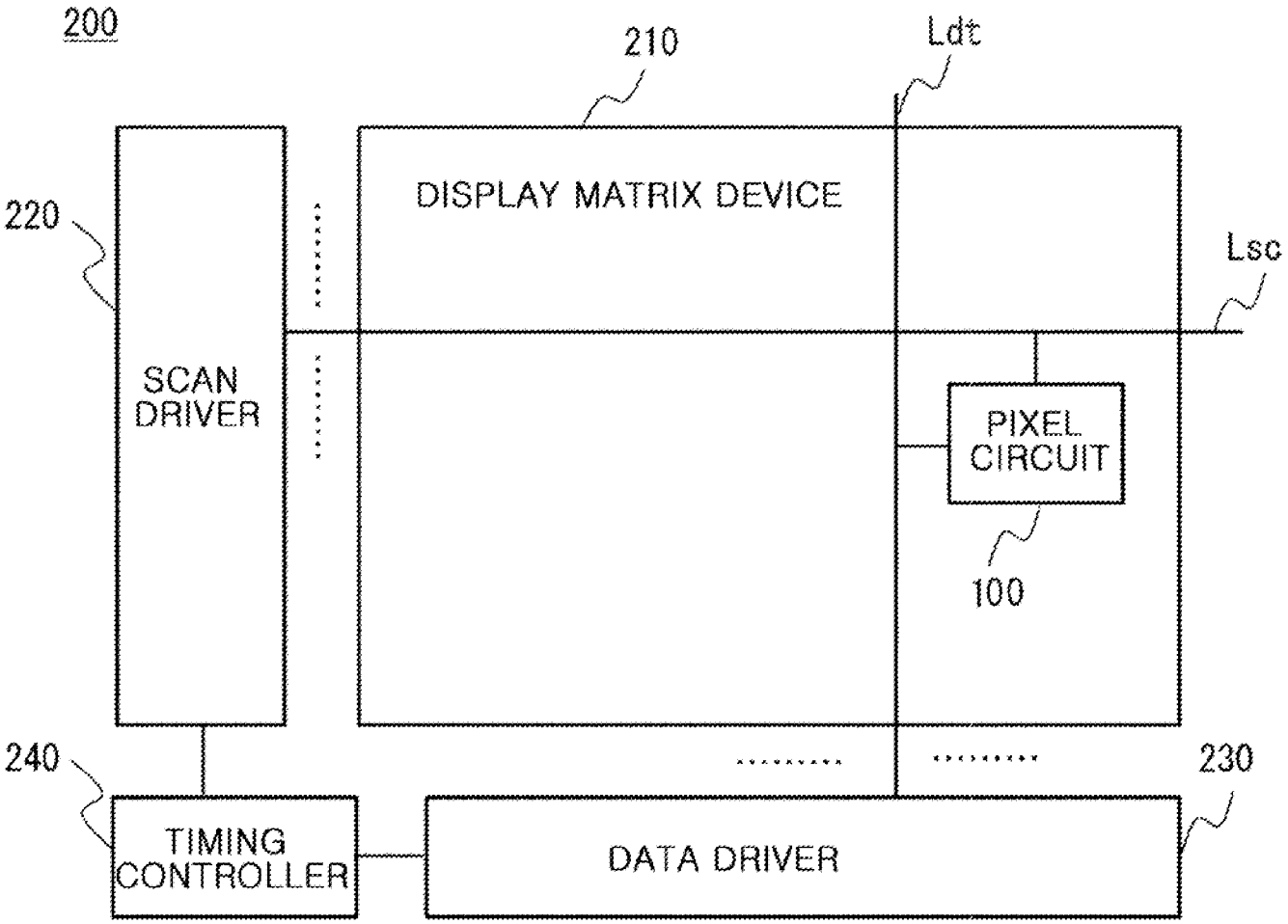
FIG. 4 is a diagram illustrating a display apparatus according to an embodiment.

FIG. 4 is a diagram illustrating a display apparatus according to an embodiment.

A display apparatus 200 is an active matrix display apparatus, for example, a micro light emitting diode (LED) display using a micro LED as the light emitting element. The micro LED display may have a higher contrast ratio than a liquid crystal display and is characterized by less degradation than an organic light emitting diode (OLED) display. Here, the disclosure is not limited to the micro LED, but may be applied to the display apparatus (pixel circuit) of an OLED or other light emitting element.

As illustrated in FIG. 4, the display apparatus 200 may include a display matrix device 210, a scan driver 220, a data driver 230, and a timing controller 240. The display matrix unit 210 may include a plurality of pixel circuits 100 arranged in a matrix form.

The display matrix device 210 may include a plurality of scan lines (gate lines) Lsc extending in a row direction, and a plurality of data lines (source lines) Ldt extending in a column direction. The pixel circuit 100 may be disposed at a location where the scan lines Lsc and the data lines Ldt intersect.

The scan driver (gate driver) 220 may sequentially select the scan lines Lsc during scanning, and drive the pixel circuit 100 of the corresponding row through the selected scan lines Lsc. The data driver (source driver) 230 may input the image signal to the pixel circuit 100 through the data line Ldt, and drive the light emitting element of the pixel circuit 100 according to an image. Further, the slope signal may be input to the pixel circuit 100 through the data line Ldt or may be input to the pixel circuit 100 through a dedicated line for the slope signal different from the data line Ldt. The timing controller 240 may control the operation of the scan driver 220 and the data driver 230, and also perform control necessary for the driving operation of the pixel circuit 100. For example, the timing controller 240 may control on/off of the switch of the pixel circuit 100 or control the timing of the slope signal or the data signal input to each terminal.

<Configuration of Pixel Circuit>

Figure 5:
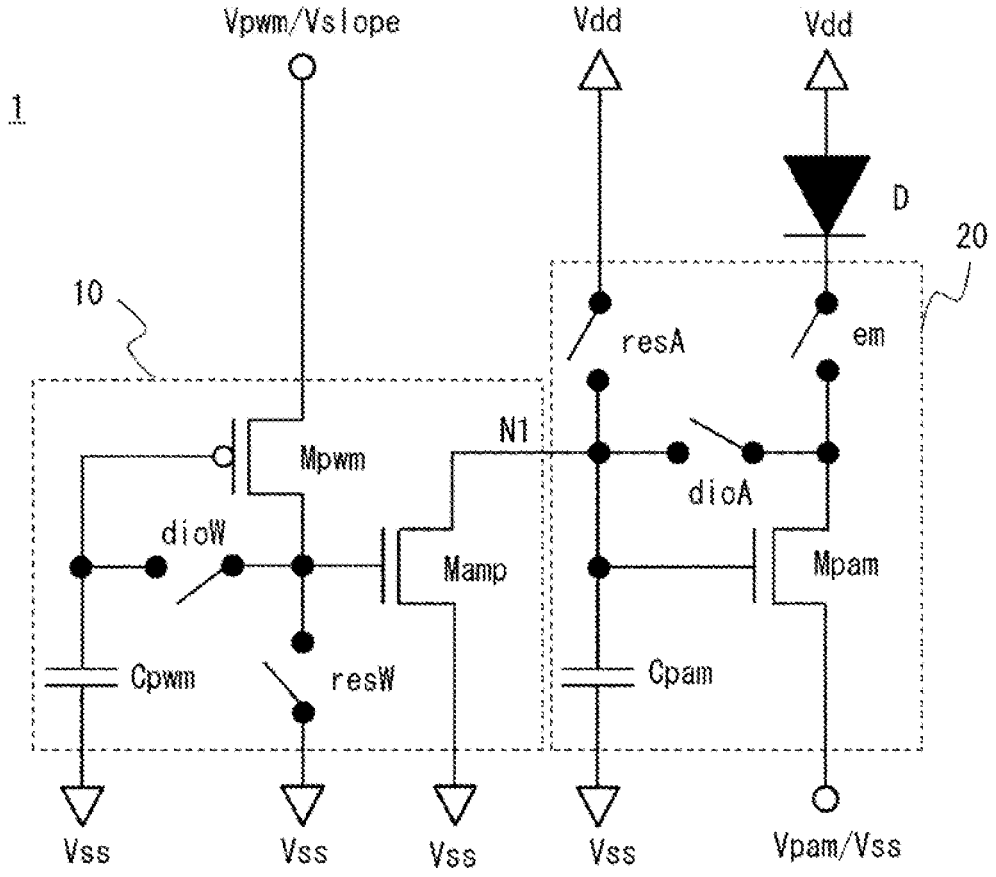
FIG. 5 is a circuit diagram illustrating a pixel circuit according to an embodiment.

FIG. 5 is a circuit diagram illustrating a configuration example of a pixel circuit according to an embodiment. As illustrated in FIG. 5, the pixel circuit 100 may include a light emitting element D, a PWM controller 10, and a constant current setting device 20.

The PWM controller 10 may include a P-type MOS transistor Mpwm, an N-type MOS transistor Mamp, switches dioW and resW, and a capacitor Cpwm. The switches (dioW, resW) may be controlled to be turned on/off by the timing controller 240.

In the MOS transistor Mpwm, the image signal Vpwm/slope signal Vslope may be input to the source, the gate may be connected to one end of the capacitor Cpwm, and the drain (output terminal) may be connected to the gate of the MOS transistor Mamp. The image signal Vpwm and the slope signal Vslope may be input from the data line Ldt at different timings. The MOS transistor Mpwm may act as the clamp type inverter. That is, the MOS transistor Mpwm may output the comparison result (PWM signal) of the gate potential (the image signal maintained in the capacitor Cpwm) and the source potential (slope signal) to the drain.

The switch dioW is connected between the gate of the MOS transistor Mpwm, the drain of the MOS transistor Mpwm, and a common node of the gate of the MOS transistor Mpwm. The switch dioW shorts the input and output of the MOS transistor Mpwm, and allows the MOS transistor Mpwm to be diode-connected.

One end of the capacitor Cpwm may be connected to the gate of the MOS transistor Mpwm and the other end of the capacitor Cpwm may be connected to the power supply Vss. The capacitor Cpwm is a capacitor for maintaining the gate potential of the MOS transistor Mpwm. In this example, when the MOS transistor Mpwm is diode-connected, the image signal supplied to the gate of the MOS transistor Mpwm may be maintained. Here, in FIG. 5, one terminal of the capacitor Cpwm may be connected to the power supply Vss, but any potential may be used when the capacitor Cpwm has a fixed potential, and the embodiment is not limited thereto.

The MOS transistor Mamp has its gate connected to the drain of the MOS transistor Mpwm, its drain connected to the output terminal N1 of the PWM controller 10 (gate of the MOS transistor Mpwm), and its source connected to the power supply Vss. The MOS transistor Mamp may amplify the PWM signal appearing at the drain of the MOS transistor Mpwm. In addition, as will be described later, since the gate of the MOS transistor Mamp (=the drain of the MOS transistor Mpwm) is floating during some period of operation, a holding capacitor may be added to the corresponding node if necessary.

The switch resW may be connected between the drain of the MOS transistor Mpwm and the common node of the gate of the MOS transistor Mp and the power supply Vss. The switch resW may initialize the gate potential of the MOS transistor Mamp and the drain potential (=the gate potential of Mamp) of the MOS transistor Mpwm. At this time, for the switches dioW and resW, for example, a MOS transistor unit or its serial connection or parallel connection may be considered, but any configuration is possible as long as the same function can be realized. The same is true for each switch of the constant current setting device 20.

Except for signals and power that control the on/off of the switches dioW and resW, the inputs of the PWM controller 10 are the image signal Vpwm and the slope signal Vslope, and the PWM signal may be output from the drain of the MOS transistor Mamp.

In this example, a configuration of connecting the output terminal N1 of the PWM controller 10 to the gate of the MOS transistor Mpam is illustrated, and the output terminal N1 may be configured to output a Vss level or obtain two states of high impedance. When the drain voltage of the MOS transistor Mpwm is lower than a threshold value (in a case of a first level), the MOS transistor Mamp makes the output terminal N1 high impedance. When the drain voltage of the MOS transistor Mpwm is higher than the threshold value (in a case of a second level), the MOS transistor Mamp may set the output terminal N1 to the Vss level (may be amplified). Here, this is only an example, and the embodiment is not limited to this configuration. Depending on a connection type between the PWM controller 10 and the constant current setting device 20, for example, a pull-up circuit element may be added to the output terminal N1 to output two states of Vdd/Vss level. That is, the MOS transistor Mamp (amplifier) may change the level of the output terminal N1 or the impedance of the output terminal N1 according to the output of the MOS transistor Mpwm.

The constant current setting device 20 may include the N-type MOS transistor Mpam, switches resA, dioA, and em, and a capacitor Cpam. The switches resA, dioA, and em may be turned on/off by the timing controller 240. Here, the configuration of the constant current setting device 20 is only an example, and is not limited to this configuration. That is, the constant current setting device 20 may have a different configuration as long as it can supply the constant current to the light emitting element D according to the output (PWM signal) of the PWM controller 10.

In the MOS transistor Mpam (constant current generating transistor), the drain may be connected to a cathode of the light emitting element D through the switch em, the gate may be connected to the output terminal N1 of the PWM controller 10 and one end of the capacitor Cpam, and a constant current setting signal Vpam/power Vss may be input to the source. The MOS transistor Mpam may function as the constant current source by operating in a saturation region.

One end of the capacitor Cpam may be connected to the gate of the MOS transistor Mpam, and the other end of the capacitor Cpam may be connected to the power source Vss. The capacitor Cpam may maintain the gate potential of the MOS transistor Mpam.

The switch resA may be connected between the power supply Vdd and the gate of the MOS transistor Mpam and the common node of the capacitor Cpam. The switch resA may initialize the gate potential of the MOS transistor Mpam.

The switch dioA may be connected between the gate of the MOS transistor Mpam and the common node of the capacitor Cpam and the drain of the MOS transistor Mpam, and allow the MOS transistor Mpam to be diode connected. The switch em may be connected between the cathode of the light emitting element D and the drain of the MOS transistor Mpam. The switches dioA and em may be used in a series of operations to compensate for a variation in the threshold value of the MOS transistor Mpam operating as the constant current source.

<Driving Method of Pixel Circuit>

Figure 6:
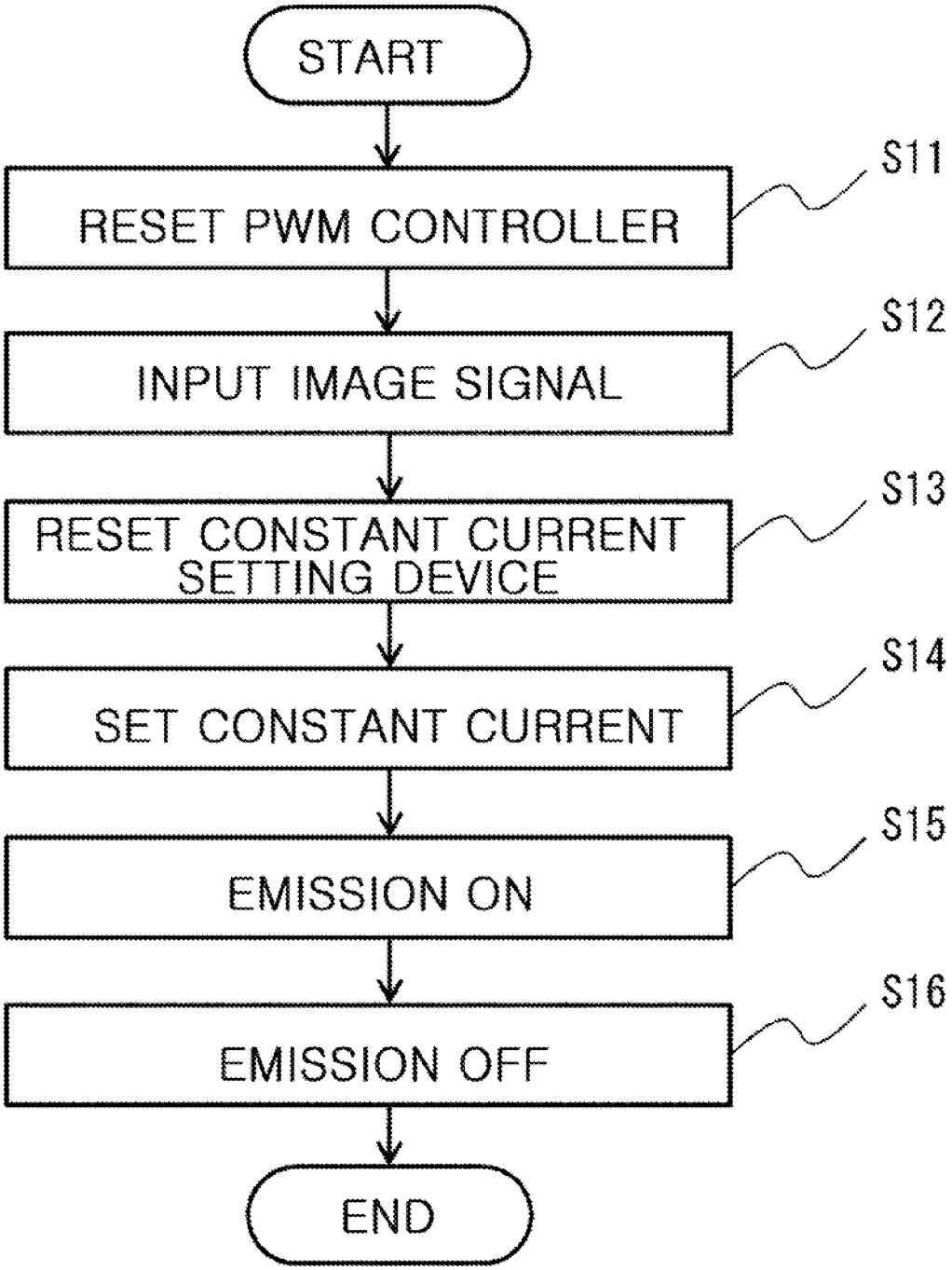
FIG. 6 is a flowchart illustrating a method of driving a pixel circuit according to an embodiment.
Figure 7:
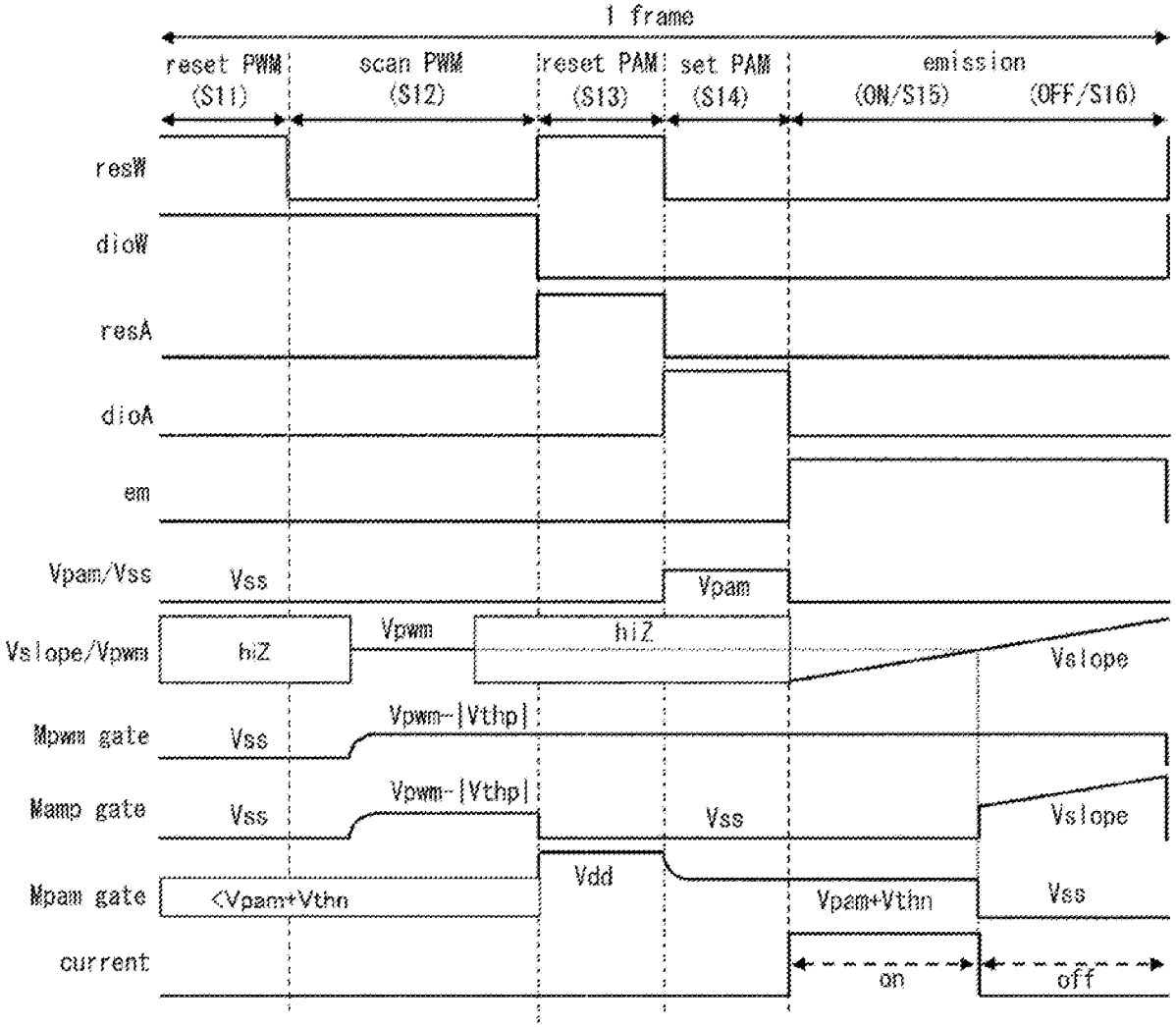
FIG. 7 is a timing chart illustrating each signal in a method of driving a pixel circuit according to an embodiment.

A method of driving the pixel circuit according to the embodiment will be described with reference to FIGS. 6 to 13. FIG. 6 is a flowchart illustrating a method of driving a pixel circuit according to an embodiment, FIG. 7 is a timing chart illustrating each signal in the driving method of FIG. 6, and FIGS. 8 to 13 are circuit diagrams illustrating a state of a pixel circuit in the driving method of FIG. 6. For example, the light emitting element is driven by the following driving method for every frame of the image signal.

Figure 8:
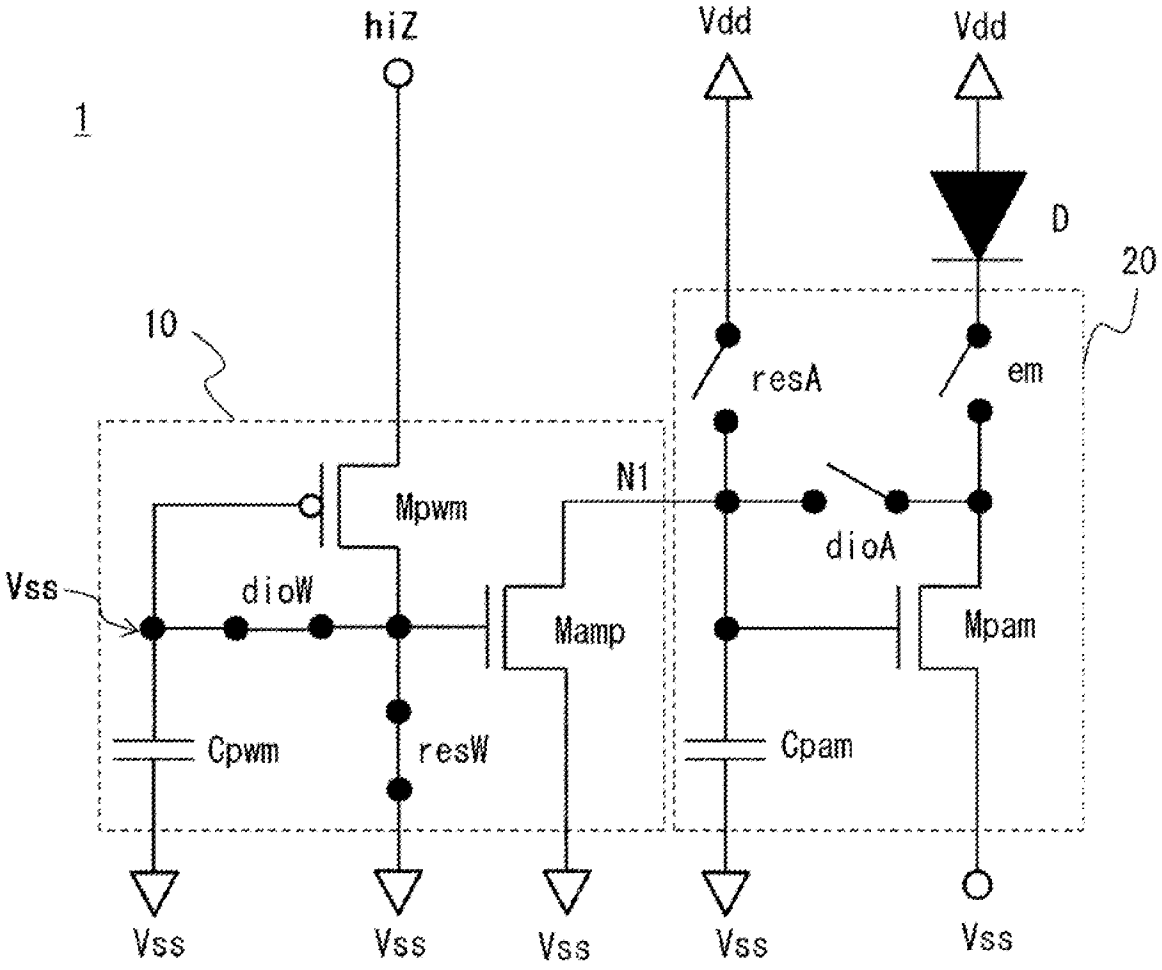
FIG. 8 is a circuit diagram illustrating a state of a pixel circuit in a method of driving the pixel circuit according to an embodiment.

As illustrated in FIG. 6, the display apparatus 200 may reset the PWM controller 10 (reset PWM: S11). As illustrated in FIGS. 7 and 8, the timing controller 240 may turn on the switches dioW and resW. Through this operation, the gate potential of the MOS transistor Mpwm may be initialized to Vss. In this case, the source of the MOS transistor Mpwm may be the high impedance hi-Z. Also, the switches resA, dioA, and em may be turned off.

Figure 9:
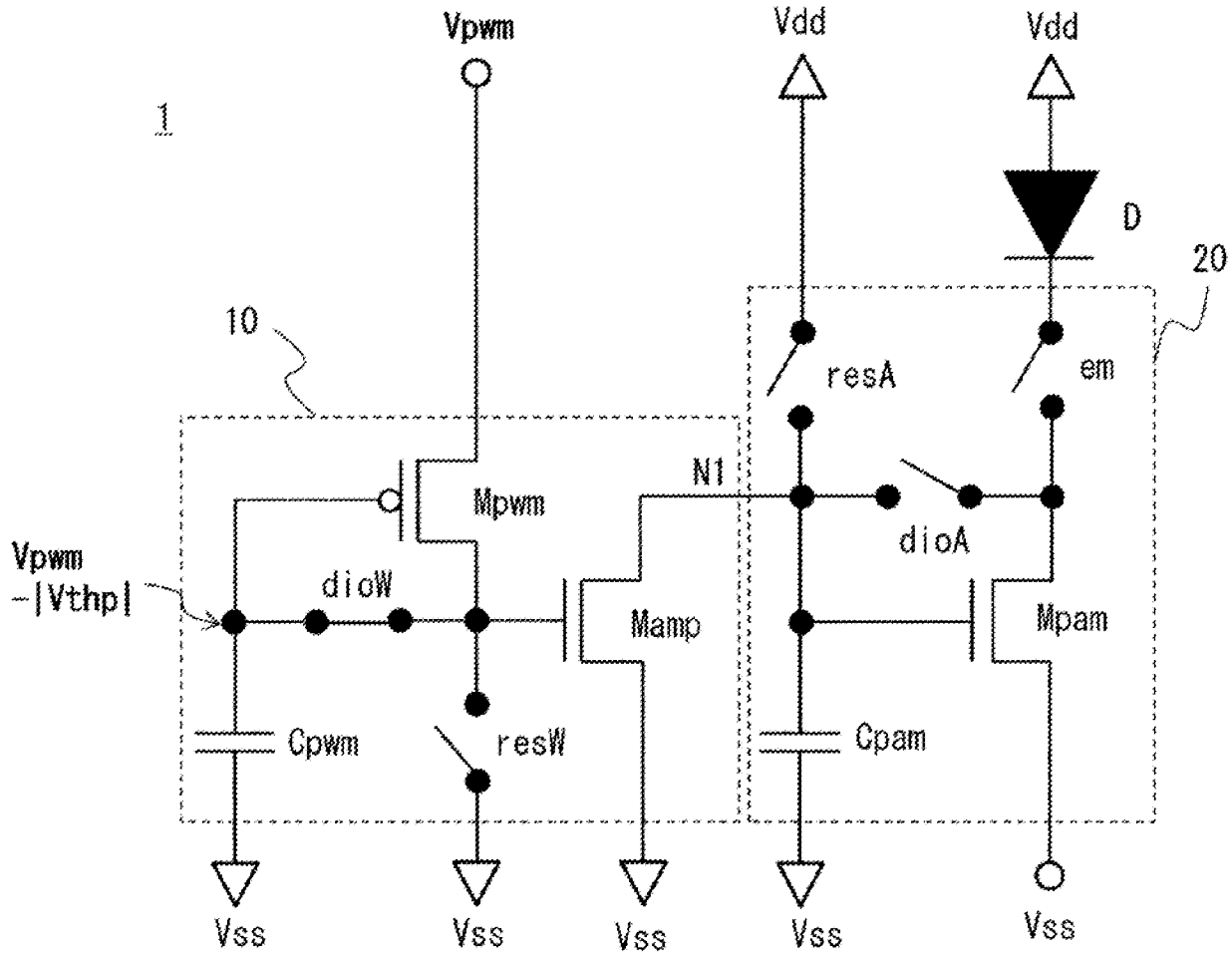
FIG. 9 is a circuit diagram illustrating a state of a pixel circuit in a method of driving the pixel circuit according to an embodiment.

Subsequently, the display apparatus 200 may record the image signal (scan PWM: S12). As illustrated in FIGS. 7 and 9, the timing controller 240 may turn off the switch resW. Through this operation, the gate and drain of the MOS transistor Mpwm may be separated from the power source Vss.

In this state, the image signal Vpwm is input from the source of the MOS transistor Mpwm. At this time, since the gate and drain of the MOS transistor Mpwm are short-circuited, the MOS transistor Mpwm operates as the diode, so that the image signal Vpwm may be supplied from the source to the gate of the MOS transistor Mpwm. Thereby, according to Vpwm, the cathode side potential (gate potential) asymptotes Vpwm-|Vthp (Mpwm's threshold value)|, and the potential is maintained in the capacitor Cpwm. When the gate potential of the MOS transistor Mpwm rises to Vpwm-|Vthp|, the MOS transistor Mpwm may turn off. In this way, the potential in which the threshold value of the MOS transistor Mpwm in charge of the clamp type inverter function is superimposed on the image signal Vpwm may be generated.

Figure 10:
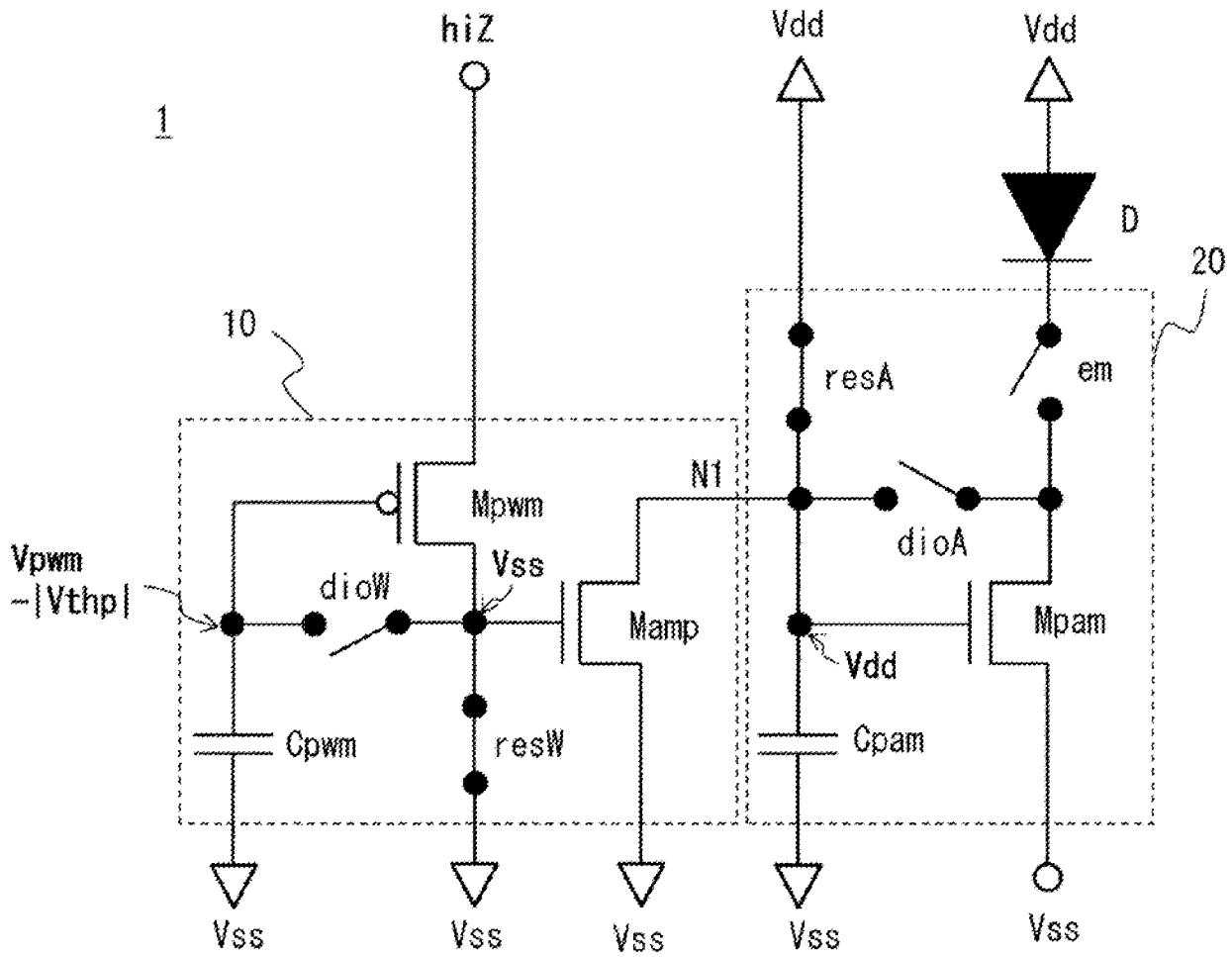
FIG. 10 is a circuit diagram illustrating a state of a pixel circuit in a method of driving the pixel circuit according to an embodiment.

Subsequently, the display apparatus 200 may reset the constant current setting device 20 (reset PAM: S13). As illustrated in FIGS. 7 and 10, the timing controller 240 may turn off the switch dioW. Through this operation, the gate and the drain of the MOS transistor Mpwm are separated, and an overlap potential Vpwm-|Vthp| of Vpwm and the threshold value is maintained in the capacitor Cpwm.

In addition, the timing controller 240 may turn on the switch resW. Accordingly, the drain potential of the MOS transistor Mpwm and the gate potential of the MOS transistor Mamp are initialized to the power source Vss again, and the MOS transistor Mamp is turned off. In addition, the timing controller 240 may turn on the switch resA. Through this operation, the gate potential of the MOS transistor Mpam is initialized to the power supply Vdd. By turning off the MOS transistor Mamp, the gate potential of the MOS transistor Mpam may be reliably initialized. At this time, the source of the MOS transistor Mpwm becomes the high impedance.

Figure 11:
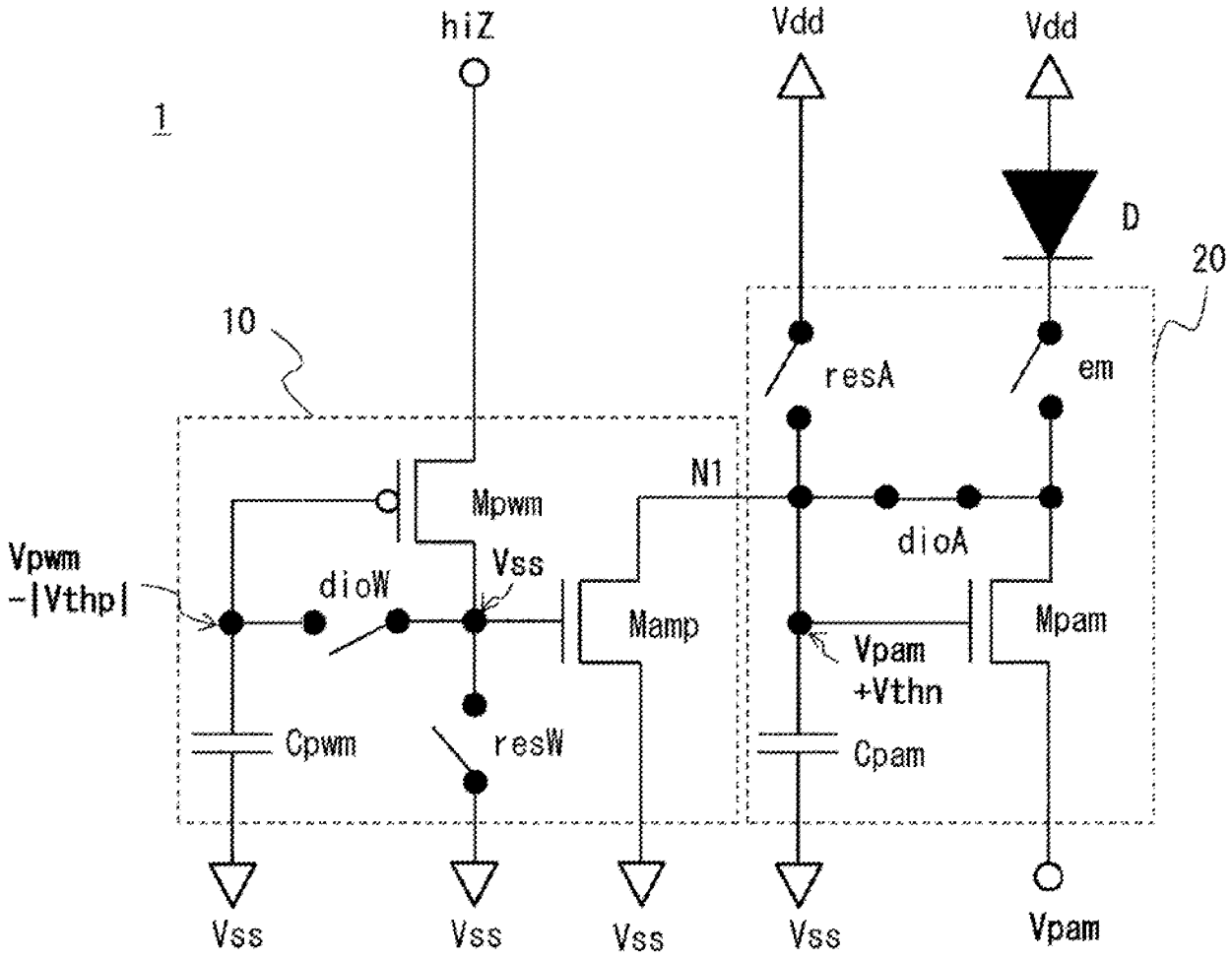
FIG. 11 is a circuit diagram illustrating a state of a pixel circuit in a method of driving the pixel circuit according to an embodiment.

Subsequently, the display apparatus 200 may set the constant current (set PAM: S14). As illustrated in FIGS. 7 and 11, the timing controller 240 may turn on the switch dioA to diode-connect the MOS transistor Mpam.

In this state, the constant current setting signal Vpam may be applied to the source of the MOS transistor Mpam. Thereby, an operation of obtaining the threshold value of the MOS transistor Mpam may be performed similarly to S12. That is, as in S12, the gate potential of the MOS transistor Mpam decreases from Vdd to Vpam+Vthn (Mpam threshold value) as the constant current setting signal Vpam is applied. Through this, the potential in which the threshold value Vthn of the MOS transistor Mpam is superimposed on Vpam may be generated. In this way, the gate potential of the MOS transistor Mpam may be set so that the current value when operating the MOS transistor Mpam in the saturation region does not depend on the threshold value. Therefore, the threshold value compensation becomes possible.

Also, at this time, the switch resW is turned off. Here, the time of turning off the switch resW may be a time of starting operation S15.

Figure 12:
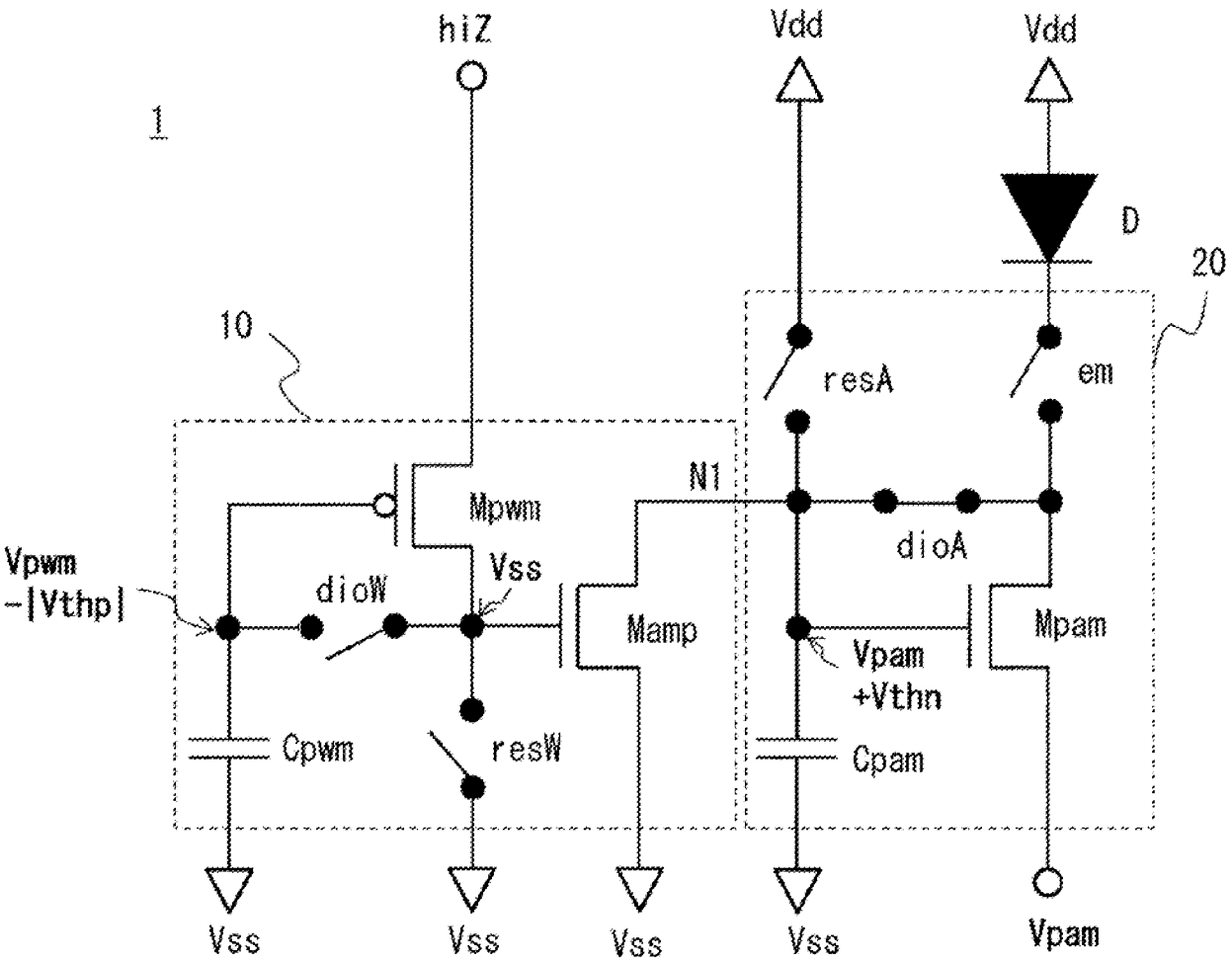
FIG. 12 is a circuit diagram illustrating a state of a pixel circuit in a method of driving the pixel circuit according to an embodiment.

Subsequently, the display apparatus 200 may emit light (emission on: S15) and light-off (emission off: S16) the light emitting element. In the emission on (S15), the timing controller 240 may turn off the switch dioA, as illustrated in FIGS. 7 and 12. Through this operation, the gate of the MOS transistor Mpam is separated from the drain, so that the capacitor Cpam can maintain the overlapping potential of Vpam and the threshold value.

Also, the slope signal Vslope may be input to the source of the MOS transistor Mpwm. Here, a component of the image signal Vpwm in the MOS transistor Mpwm that functions as the clamp type inverter may be applied to the gate, and the slope signal referred to as comparison may be applied to the source. Therefore, in the embodiment, unlike the related art, the image signal and the slope signal do not overlap.

Also, the timing controller 240 may turn on the switch em and start a light emission period. While the output terminal N1 of the PWM controller 10 is the high impedance, the capacitor Cpam is not discharged and the MOS transistor Mpam is on, so that the light emitting element D is driven (emitted) with the constant current. Since the output of the PWM controller 10 is applied to the gate of the MOS transistor Mpwm at S12 with the potential of Vthp superimposed on Vpwm in advance, the current value does not depend on Vthp and is purely determined by comparing Vpwm and Vslope. Therefore, while Vpwm>Vslope, since the output of the PWM controller 10 is the high impedance, the light emitting element D may continue to emit light.

Figure 13:
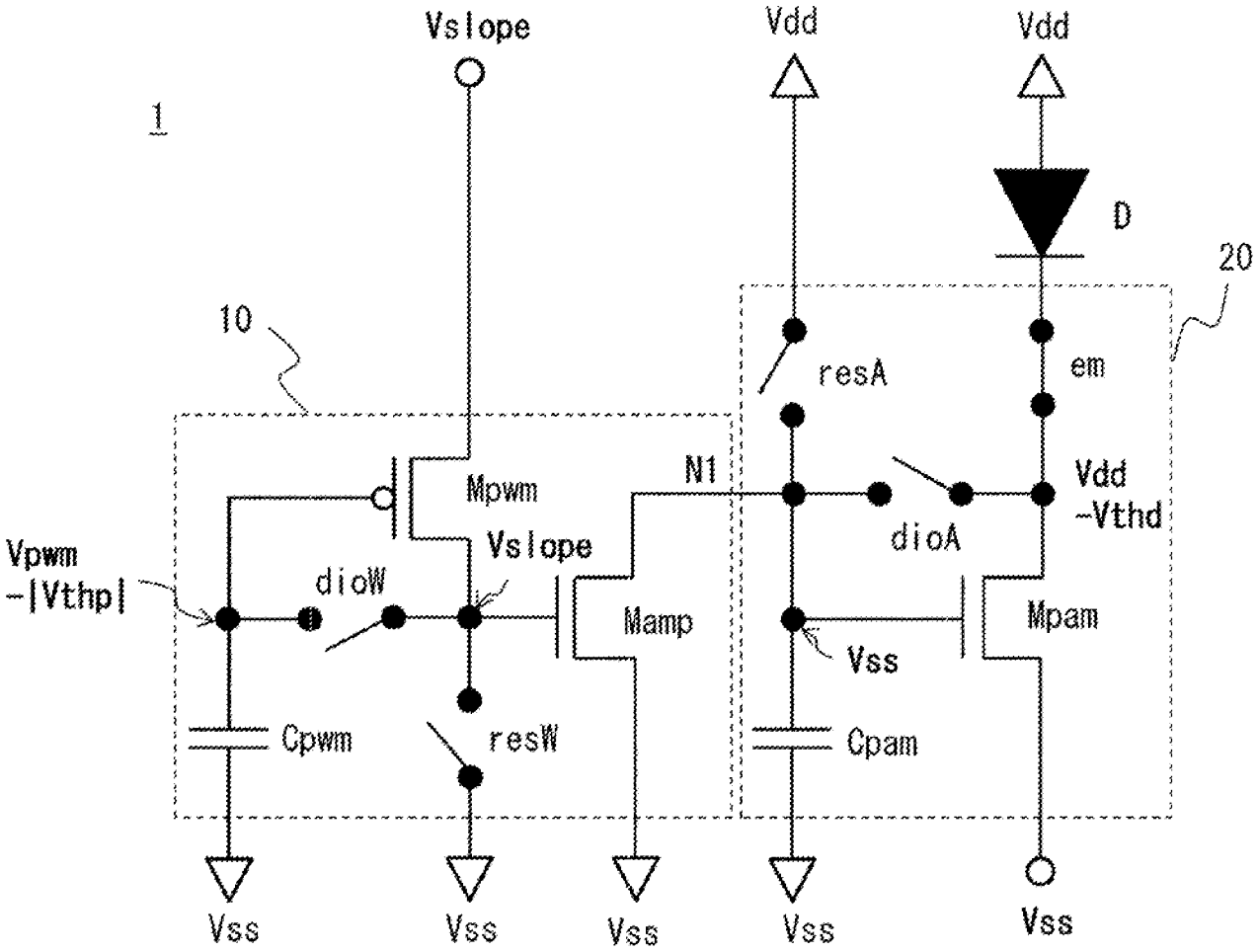
FIG. 13 is a circuit diagram illustrating a state of a pixel circuit in a method of driving the pixel circuit according to an embodiment.

Subsequently, in the emission off (S16), as illustrated in FIGS. 7 and 13, the slope signal Vslope may change from a low potential to a high potential in a slope shape. When Vpwm<Vslope, the MOS transistor Mpwm is turned on, so that the slope signal can be supplied to the gate of the MOS transistor Mamp. Accordingly, since the MOS transistor Mamp is turned on, the output of the PWM controller 10 becomes Vss, and the capacitor Cpam may be discharged. Accordingly, the gate potential of the MOS transistor Mpam becomes Vss, the MOS transistor Mpam is turned off, and the light emitting element D may be turned off. In this way, the light emission time according to the image signal Vpwm may be realized. At this time, in order to express the light emission time 0 (black), it is necessary to set the state of Vpwm<Vslope before turning on the switch em, so the potential or the timing of turning on the switch em may be adjusted when the slope of the Vslope starts.

In addition, the input of the image signal of S12 may be sequentially performed for each scan line according to the scan of the scan line in the 2D active matrix display apparatus as illustrated in FIG. 4. To this end, a selection switch is required for each pixel, but it is not included in the drawings for convenience of description and the description thereof is omitted here. For other operations (steps), it is basically assumed that all of the pixels constituting the active matrix are collectively and simultaneous preformed, but this is not particularly limited, and a method of grouping and sequentially executing pixels may be employed. In addition, for example, it may be executed differently from the order described above, such as inputting the image signal after performing the constant current setting in advance (in this case, the PWM controller may be the same, but other elements need to be changed).

Effect of Embodiment

In the configuration and driving method of the pixel circuit according to the embodiment described above, conditions for limiting the input voltage range of the image signal (Vpwm) are as follows.

Vpwm-|Vthp|>Vss (condition for establishing the threshold value acquisition operation in step S12)

Vpwm<Vdd (element internal pressure)

In the above, the voltage amplitude that can be input as the image signal Vpwm becomes Vdd−(Vss+|Vthp|). Unlike (Vdd−Vss)/2 in the related art, according to the embodiment, the dynamic range may be expanded based on (Vdd-Vss)/2-|Vthp|. That is, in the embodiment, since the input of the image signal and the slope signal are not overlapped by the clamp type inverter, the dynamic range may be expanded.

In addition, in the embodiment, by implementing the clamp type inverter with one MOS transistor, the number of elements may be reduced, and further, by actively introducing dynamic operation, power consumption may be reduced by excluding elements of current generation.

In an embodiment, an amplifier Mamp of the PWM controller may be configured as an inverter in a pixel circuit.

<Configuration of Pixel Circuit>

Figure 14:
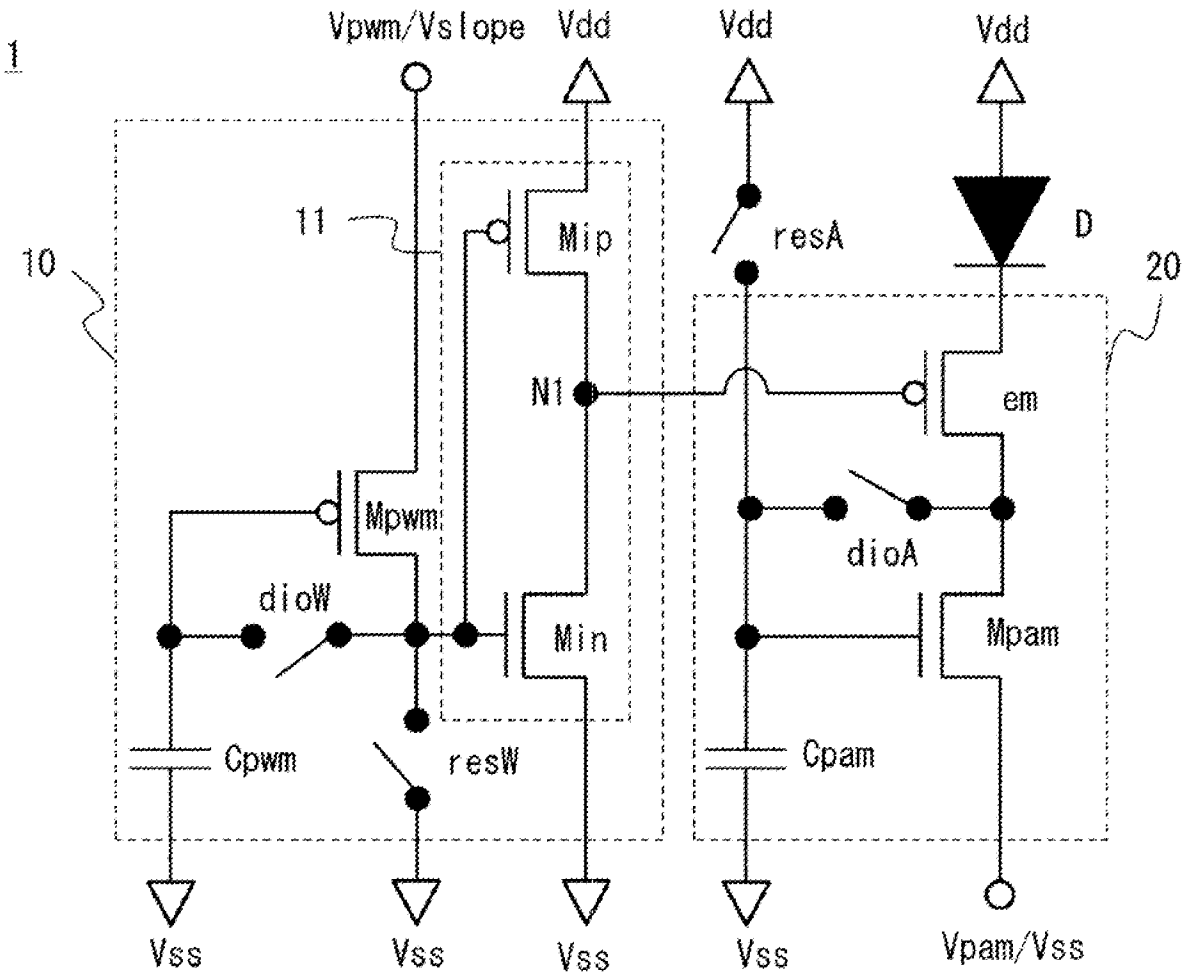
FIG. 14 is a circuit diagram illustrating a pixel circuit according to an embodiment.

FIG. 14 is a circuit diagram illustrating a pixel circuit according to an embodiment. As illustrated in FIG. 14, the pixel circuit 100 may include the light emitting element D, the PWM controller 10, and the constant current setting device 20. Compared with the pixel circuit of the embodiment described above with reference to FIGS. 5-13, here, the PWM controller 10 has a different output portion to the constant current setting device 20, and the constant current setting device 20 has a different input portion from the PWM controller 10.

Particularly, as illustrated in FIG. 14, the PWM control 10 may include a PWM output amplification inverter 11 that inverts and amplifies the output of the MOS transistor Mpwm instead of the MOS transistor Mamp. The PWM output amplification inverter 11 may include a P-type MOS transistor Mip and an N-type MOS transistor Min connected in series between the power supply Vdd and the power supply Vss. Further, in this example, the switch em of the constant current setting device 20 is the P-type MOS transistor. The input terminal of the PWM output amplification inverter 11 may be connected to the drain of the MOS transistor Mpwm, similar to the MOS transistor Mamp. The output terminal N1 of the PWM output amplification inverter 11 may be connected to the gate of the switch em.

<Driving Method of Pixel Circuit>

Figure 15:
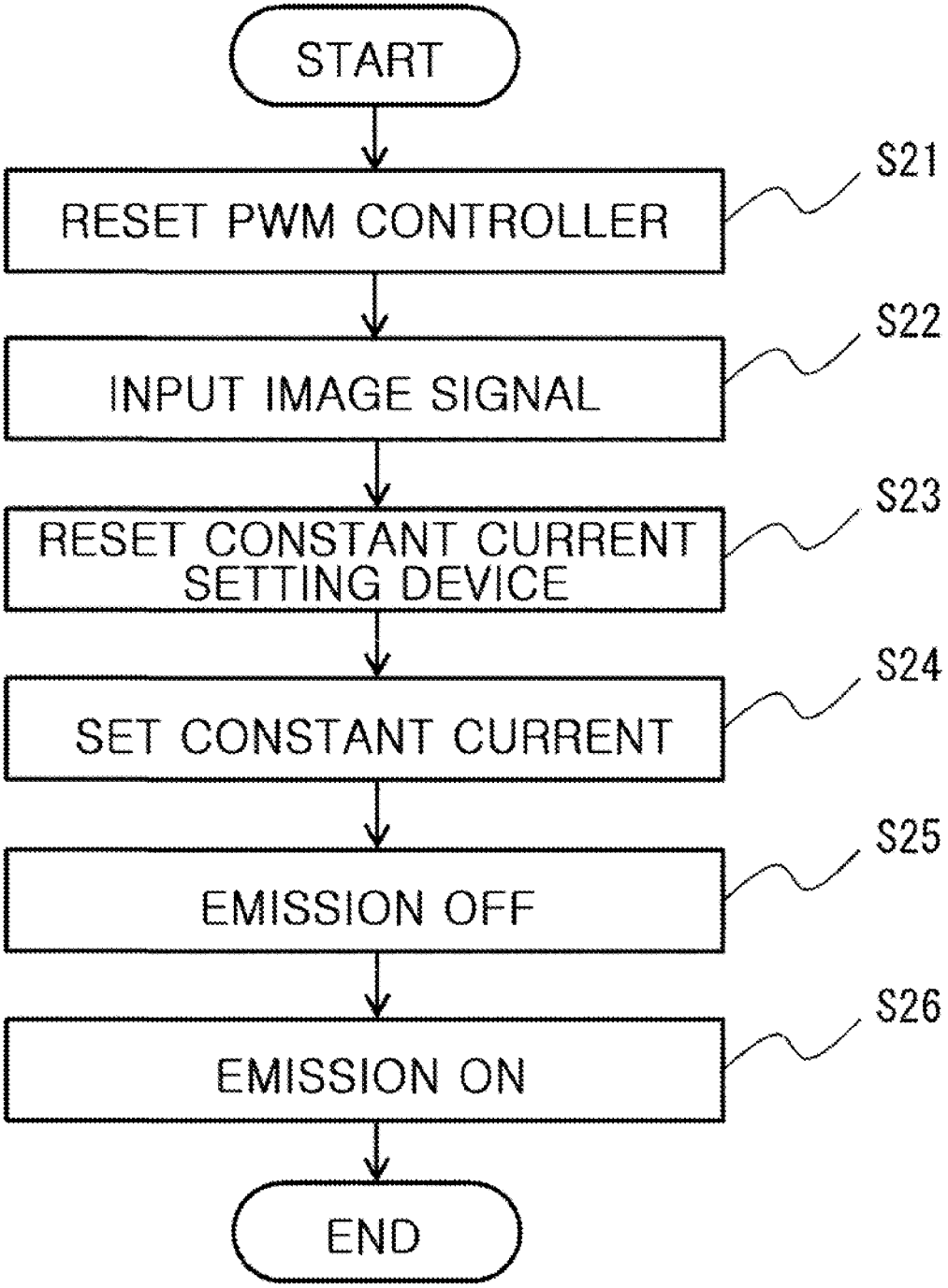
FIG. 15 is a flowchart illustrating a method of driving a pixel circuit according to an embodiment.
Figure 16:
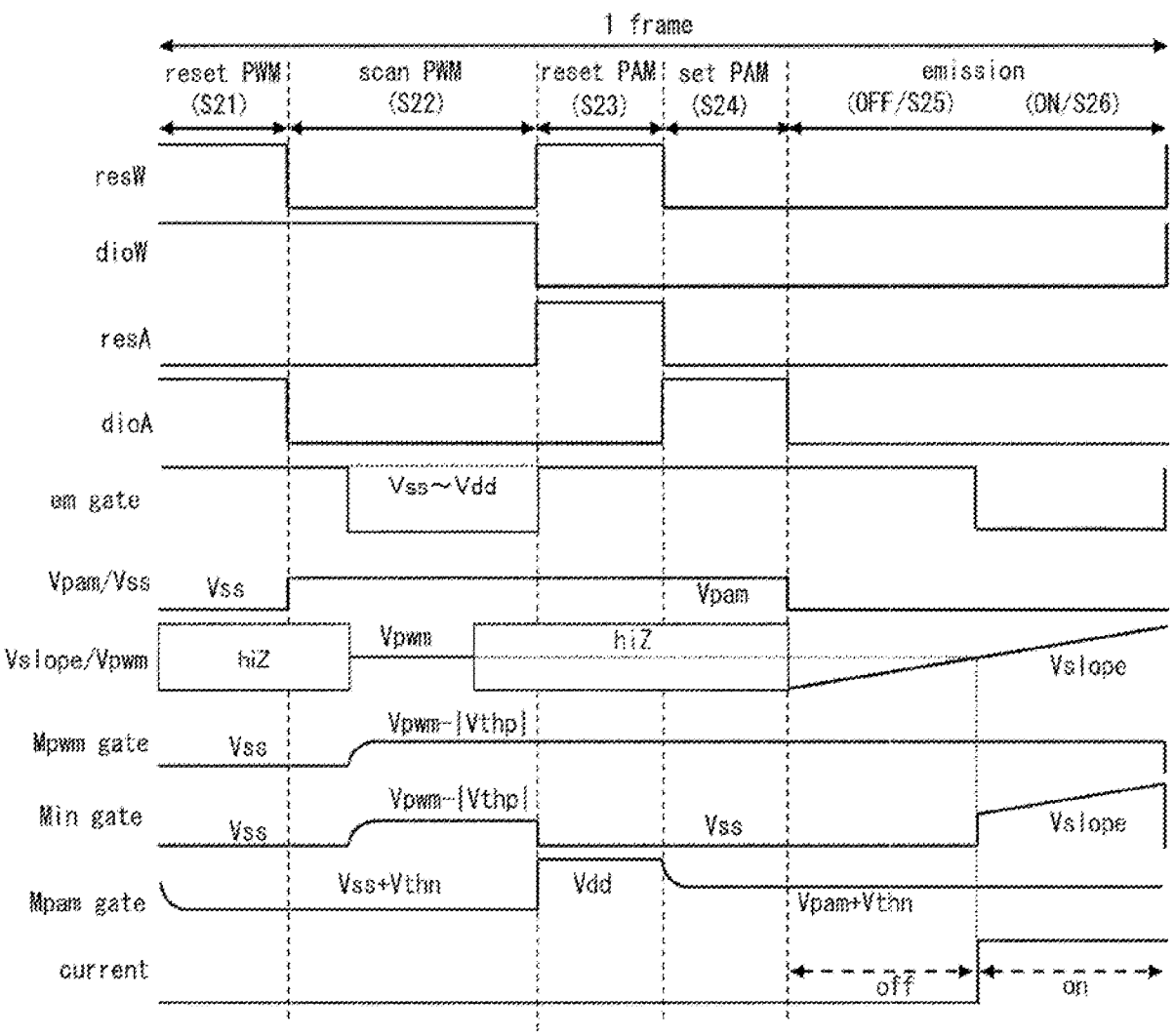
FIG. 16 is a timing chart illustrating each signal in a method of driving a pixel circuit according to an embodiment.

A method of driving the pixel circuit according to the embodiment will be described with reference to FIGS. 15 to 22. FIG. 15 is a flowchart illustrating a method of driving a pixel circuit according to an embodiment, FIG. 16 is a timing chart illustrating each signal in the driving method of FIG. 15, and FIGS. 17 to 22 are circuit diagrams illustrating a state of a pixel circuit in the driving method of FIG. 15.

The driving method of the embodiment differs from the one of the embodiments in the following.

In order to not emit light during scan PWM (S22), the gate voltage of the MOS transistor Mpam of the constant current source may be initialized to the low potential at the time of reset PWM (S21). Thereafter, the MOS transistor Mpam is not turned on, and the source potential of the MOS transistor Mpam may be Vpam>Vss.

Since it does not emit light when Vpwm>Vslope, and emits light when Vpwm<Vslope, the order of emission on/off may be reversed.

Figure 17:
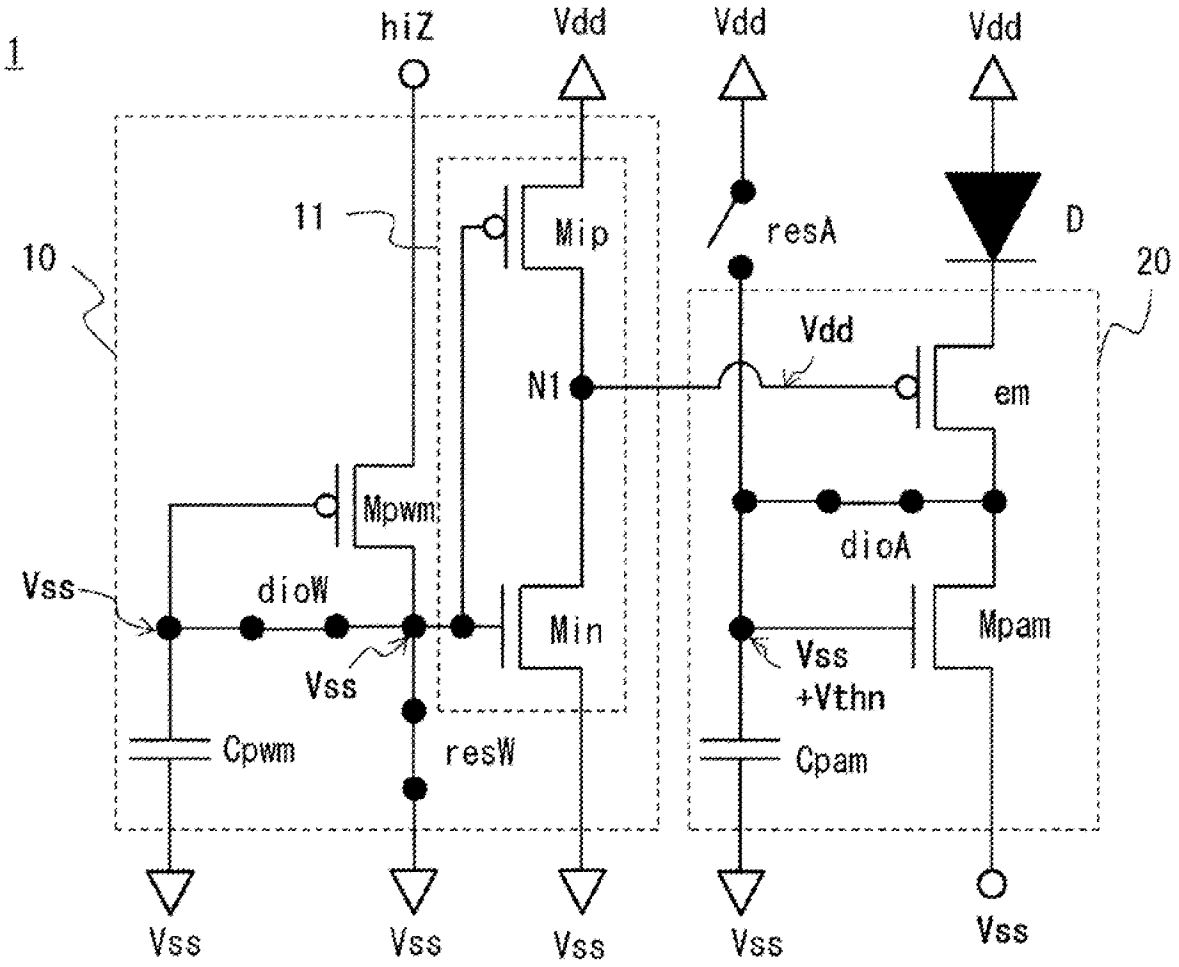
FIG. 17 is a circuit diagram illustrating a state of a pixel circuit in a method of driving the pixel circuit according to an embodiment.

In the embodiment, as illustrated in FIG. 15, the display apparatus 200 may reset the PWM controller 10 (reset PWM: S21). As illustrated in FIGS. 16 and 17, the timing controller 240 may turn on switches dioW and resW, as in the embodiment. Through this, the gate potential of the MOS transistor Mpwm is initialized to the power source Vss, and the input terminal of the PWM output amplifying inverter 11 may also become the power source Vss. Thereby, since the gate potential of the switch em becomes the power source Vdd, the switch em may be turned off. Further, the timing controller 240 may turn on the switch dioA by making the control signal of the switch dioA high. Through this operation, the gate potential of the MOS transistor Mpam may be reduced to Vss+Vthn.

Figure 18:
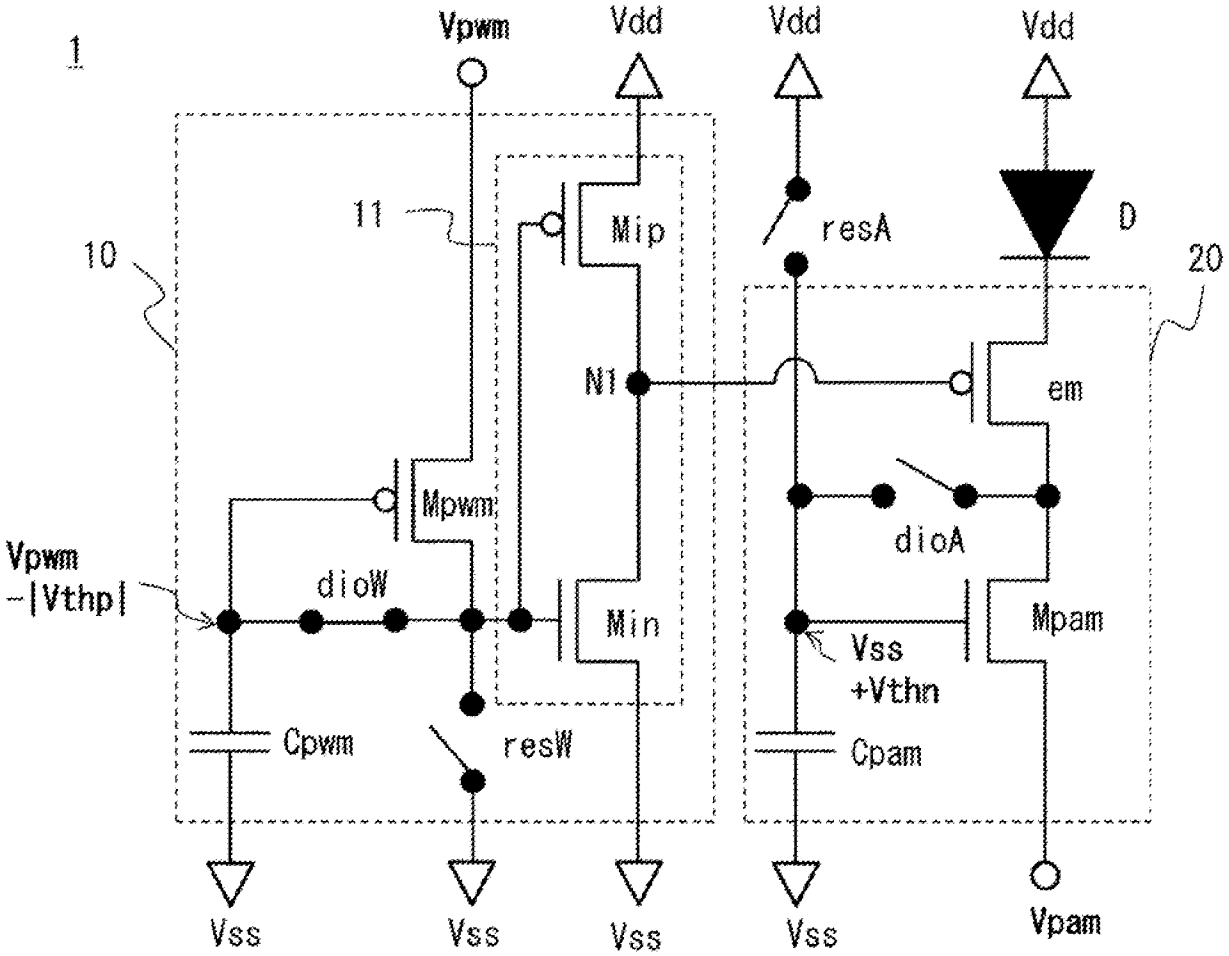
FIG. 18 is a circuit diagram illustrating a state of a pixel circuit in a method of driving the pixel circuit according to an embodiment.

Subsequently, the display apparatus 200 may input the image signal (scan PWM: S22). As illustrated in FIGS. 16 and 18, the timing controller 240 may increase the gate potential of the MOS transistor Mpwm to Vpwm-|Vthp| by inputting the image signal Vpwm from the source of the MOS transistor Mpwm while the switch resW is turned off.

In this case, the timing controller 240 may turn off the switch dioA, and the capacitor Cpam may maintain the gate potential Vss+Vthn of the MOS transistor Mpam. Also, the constant current setting signal Vpam may be input to the source of the MOS transistor Mpam. Due to this, the MOS transistor Mpam may be turned off. Since the output of the PWM output amplifying inverter 11 changes as the gate potential of the MOS transistor Mpwm increases, the switch em may be turned on by the level of the gate potential. Accordingly, as described above, the light emitting element D may be reliably turned off by turning off the MOS transistor Mpam.

Figure 19:
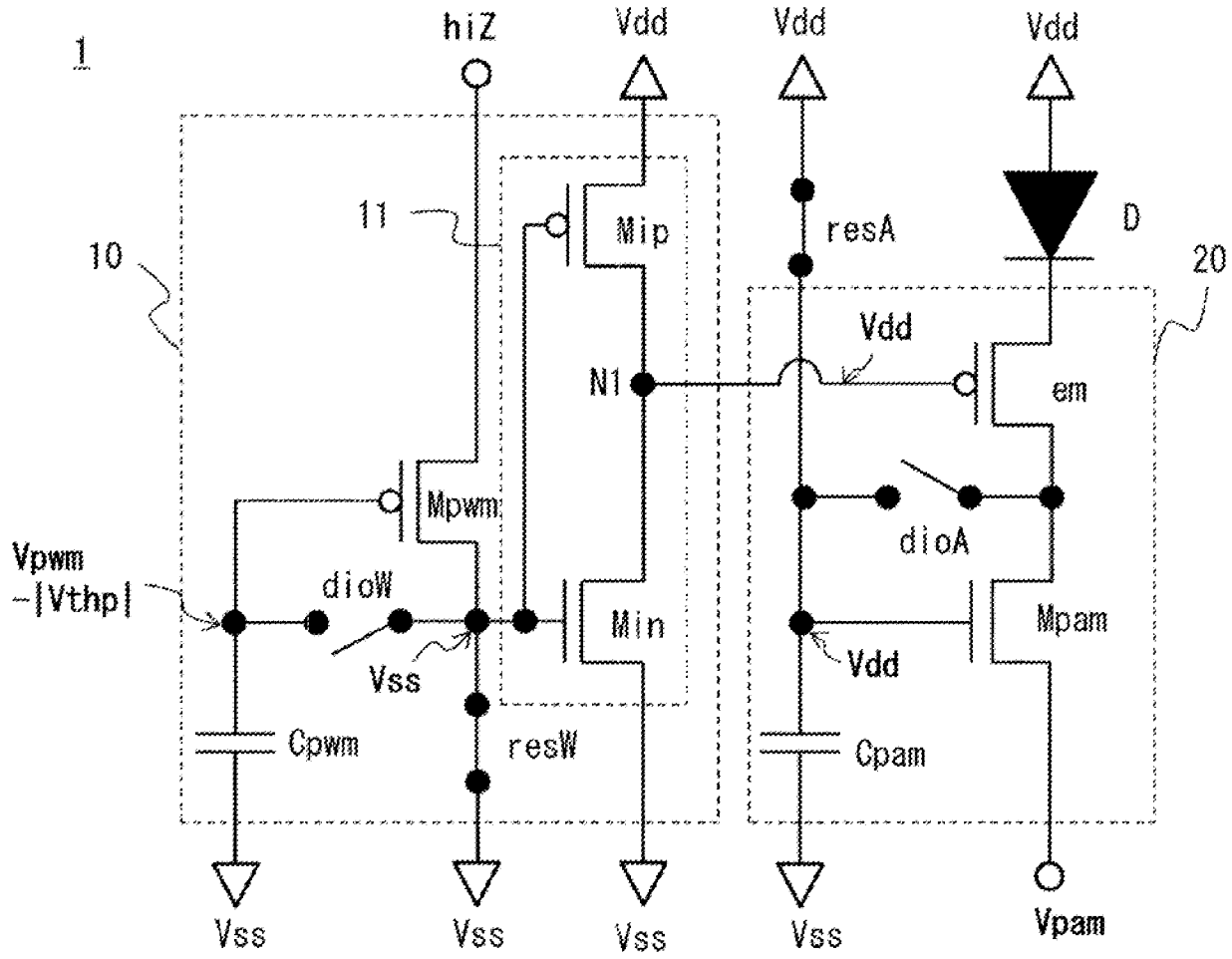
FIG. 19 is a circuit diagram illustrating a state of a pixel circuit in a method of driving the pixel circuit according to an embodiment.

Subsequently, the display apparatus 200 may reset the constant current setting device 20 (reset PAM: S23). As illustrated in FIGS. 16 and 19, when the timing controller 240 turns off the switch dioW, the capacitor Cpwm maintains Vpwm-|Vthp| in the capacitor Cpwm. When the timing controller 240 turns on the switch resW, the drain potential of the MOS transistor Mpwm may be initialized to Vss. Through this operation, the switch em may be turned off. In addition, the gate potential of the MOS transistor Mpam may be initialized to the power source Vdd.

Figure 20:
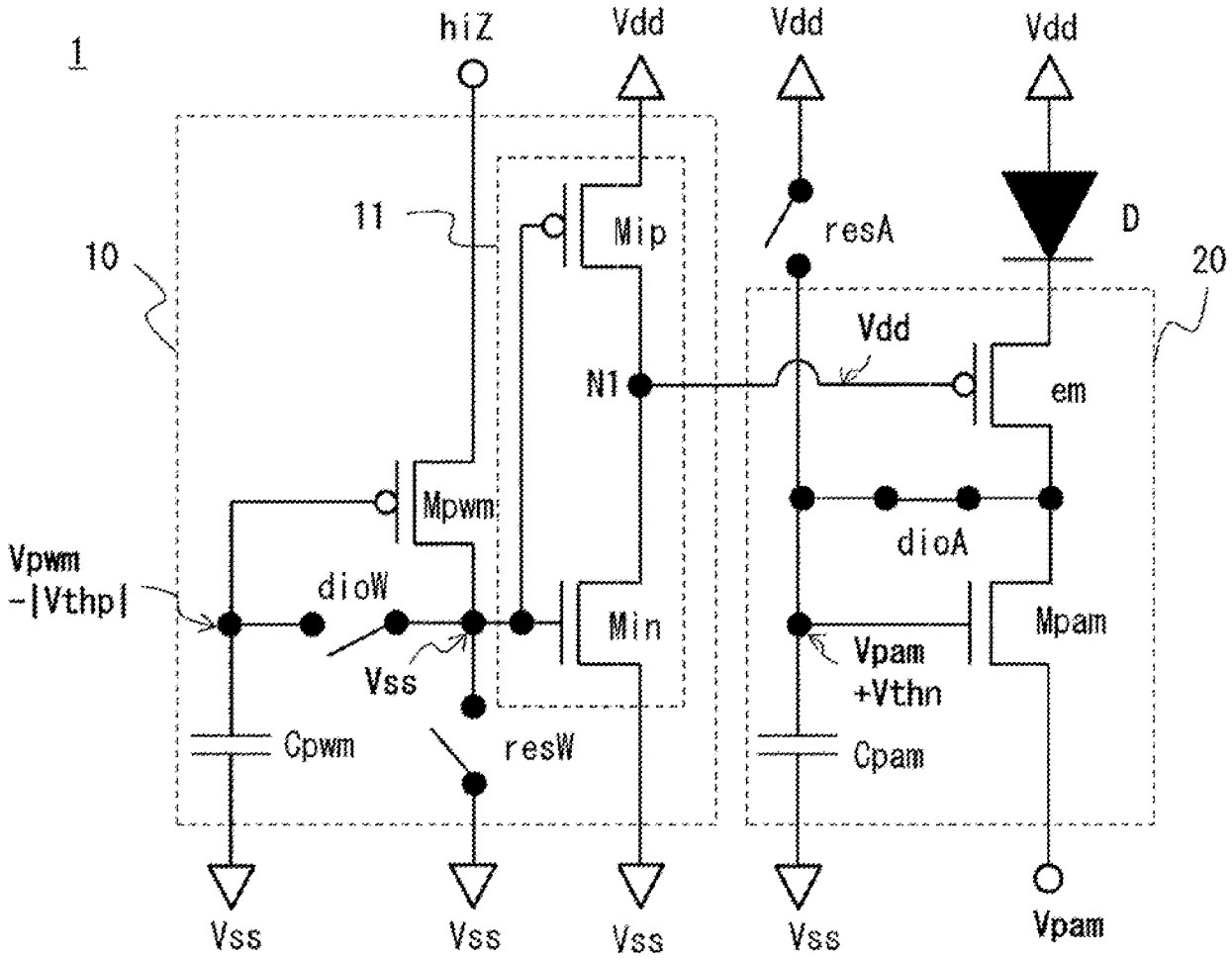
FIG. 20 is a circuit diagram illustrating a state of a pixel circuit in a method of driving the pixel circuit according to an embodiment.

Then, the display apparatus 200 may set the constant current (set PAM: S24). As illustrated in FIGS. 16 and 20, the timing controller 240 may lower the gate potential of the MOS transistor Mpam from Vdd to Vpam+Vthn by turning on the switch dioA. Also, at this time, the timing controller 240 may turn off the switch resW. At this time, since the input terminal (=the drain of the MOS transistor Mpwm) of the PWM output amplification inverter 11 is floating, a maintenance capacitor may be added to the corresponding node if necessary. In addition, the timing of turning off the switch resW may be a timing of starting the next S25.

Figure 21:
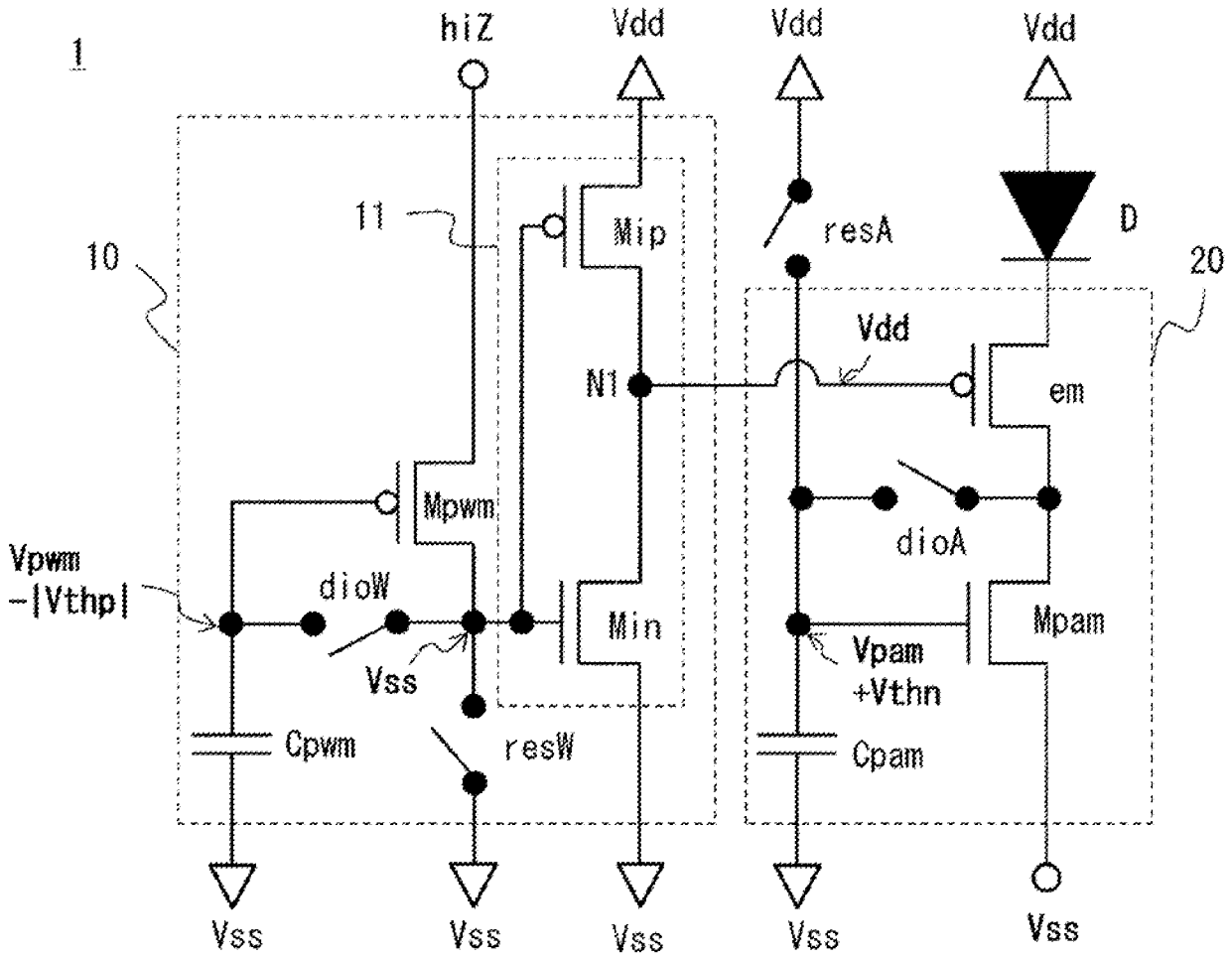
FIG. 21 is a circuit diagram illustrating a state of a pixel circuit in a method of driving the pixel circuit according to an embodiment.

Subsequently, the display apparatus 200 may turn off the light emitting element (emission off: S25) and emit light (emission on: S26). In the emission off (S25), as illustrated in FIGS. 16 and 21, the switch dioA is turned off to maintain the gate potential Vpam+Vthn of the MOS transistor Mpam in the capacitor Cpam.

Also, the slope signal Vslope may be input to the source of the MOS transistor Mpwm. Until Vpwm>Vslope, the MOS transistor Mpwm is turned off, and the drain of the MOS transistor Mpwm and the input terminal of the inverter remain at Vss. Thereby, the output of the PWM output amplification inverter 11 and the gate of the switch em may be Vdd. Accordingly, the switch em is turned off, so that the light emitting element D may be continuously turned off.

Figure 22:
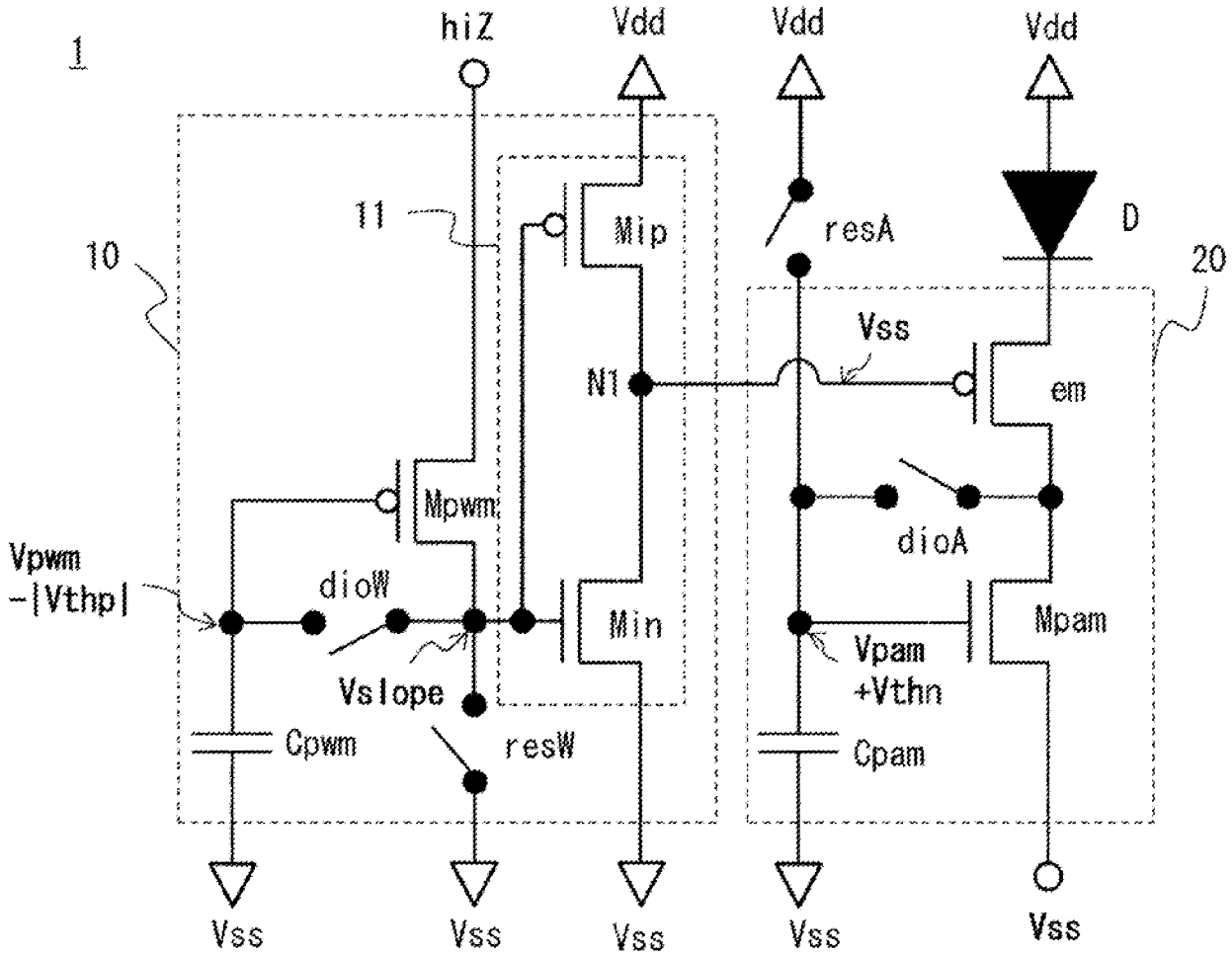
FIG. 22 is a circuit diagram illustrating a state of a pixel circuit in a method of driving the pixel circuit according to an embodiment.

Subsequently, in the emission (S26), as illustrated in FIGS. 16 and 22, the slope signal further increases. When Vpwm<Vslope, the MOS transistor Mpwm is turned on, and the slope signal is supplied to the input terminal of the PWM output amplification inverter 11. Then, since the output of the inverter and the gate potential of the switch em are lowered, the switch em is turned on, so that the light emitting element D may emit light.

As described above, in this embodiment, the output portion of the PWM controller 10 is composed of the inverter, and this output signal is connected as a control signal of the switch em, and switching of light emission/non-emission may be realized by on/off of the switch em. In the embodiment, there is a leak path connected to the power source through the MOS transistor Mamp at the gate of the MOS transistor Mpam. On the other hand, in the embodiment, since this leak path can be reduced, an improvement in maintenance characteristics during dynamic operation can be expected. At this time, the output of the PWM controller 10 needs to be Vss/Vdd instead of Vss/high impedance, so the circuit scale increases.

Figure 23:
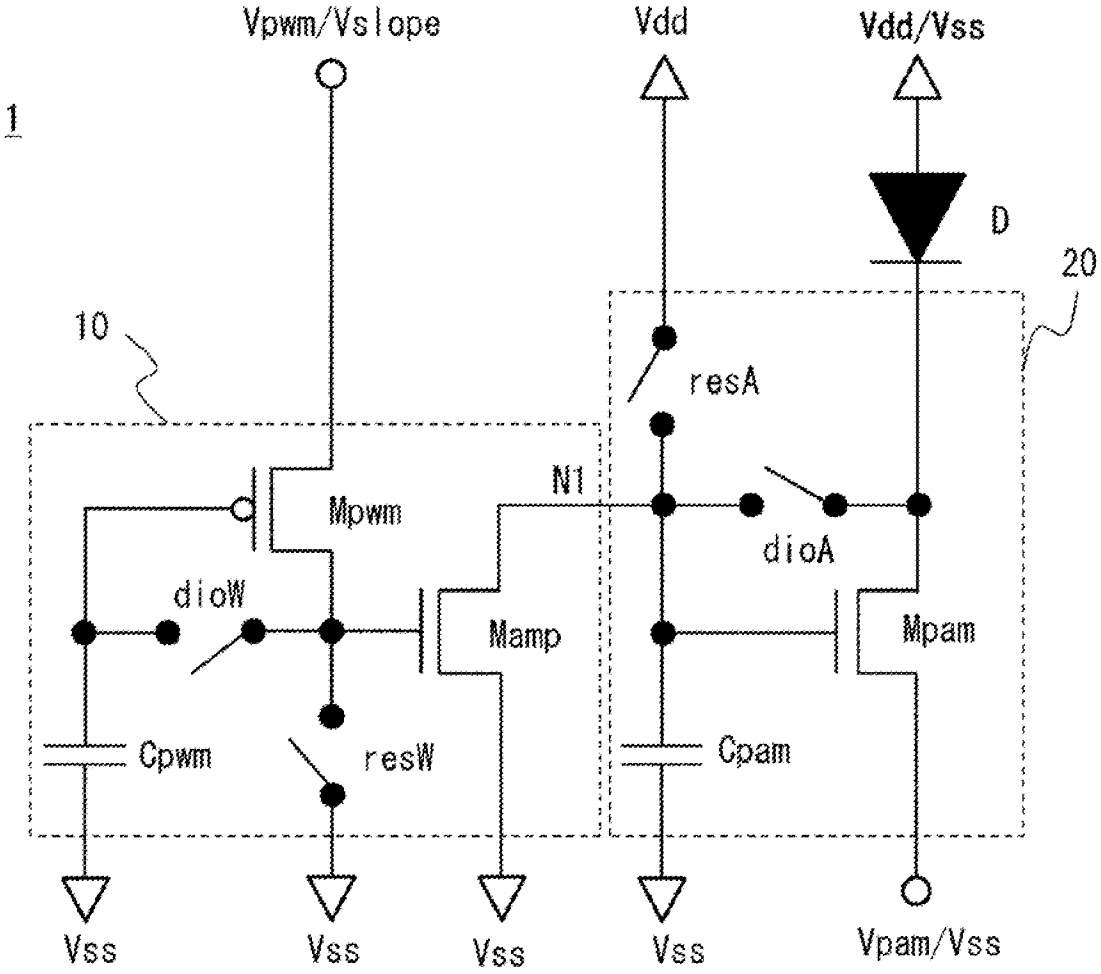
FIG. 23 is a circuit diagram illustrating a pixel circuit according to an embodiment.

FIG. 23 is a circuit diagram illustrating a pixel circuit according to an embodiment.

In this example, as illustrated in FIG. 23, the pixel circuit may not include the switch em. By excluding the voltage consumed by the switch em, a slight reduction in power consumption can be realized.

However, at least between the scan PWM (S12) and the set PAM (S14) (until the slope signal is input), it is necessary to set the anode terminal of the light emitting element to Vss instead of Vdd to prevent the current from flowing through the light emitting element. Therefore, it is necessary to control the amplitude of the power supply voltage.

Hereinafter, the display apparatus according to this embodiment will be described.

In the case of the micro LED display described above, the light emitting element and an active element may be integrated. In particular, in the case of a large display, the active element is manufactured with a micro integrated circuit (IC), and may be arranged and mounted in a two-dimensional matrix form like the micro LED on a substrate used as the display.

In mounting the micro ICs, minimization of a chip size is essential, and in general, reduction in circuit size such as a reduction in the number of input/output signals (I/O) is required. For example, in a digital pulse that controls on/off of the switch among control signals required for driving the light emitting element, a counter (stator machine) corresponding to the driving sequence is provided inside the IC, and all the stators that require the counter are operated and identified with only the clock and reset inputs, and from this information, a decoder may generate the pulses internally without relying on external inputs. Thereby, the number of I/Os of the micro IC may be reduced.

In general, a plurality of digital pulses are required, and they are often designed so that valid periods of the pulses do not overlap with each other. For example, in the 2D active matrix display, in order to sequentially input image signals to the line, the selection switch for activating a specific line is required for each pixel. However, in order to prevent erroneous input between pixels sharing the data line, restrictions such as increasing an interval between each pulse signal so that the activation periods of each pulse signal do not overlap in a plurality of scan pulse signals controlling the selection switch are provided. This limitation is not limited to the scan pulse signal, but has the possibility to affect all kinds of digital pulse signals.

<Display Apparatus>

Figure 24:
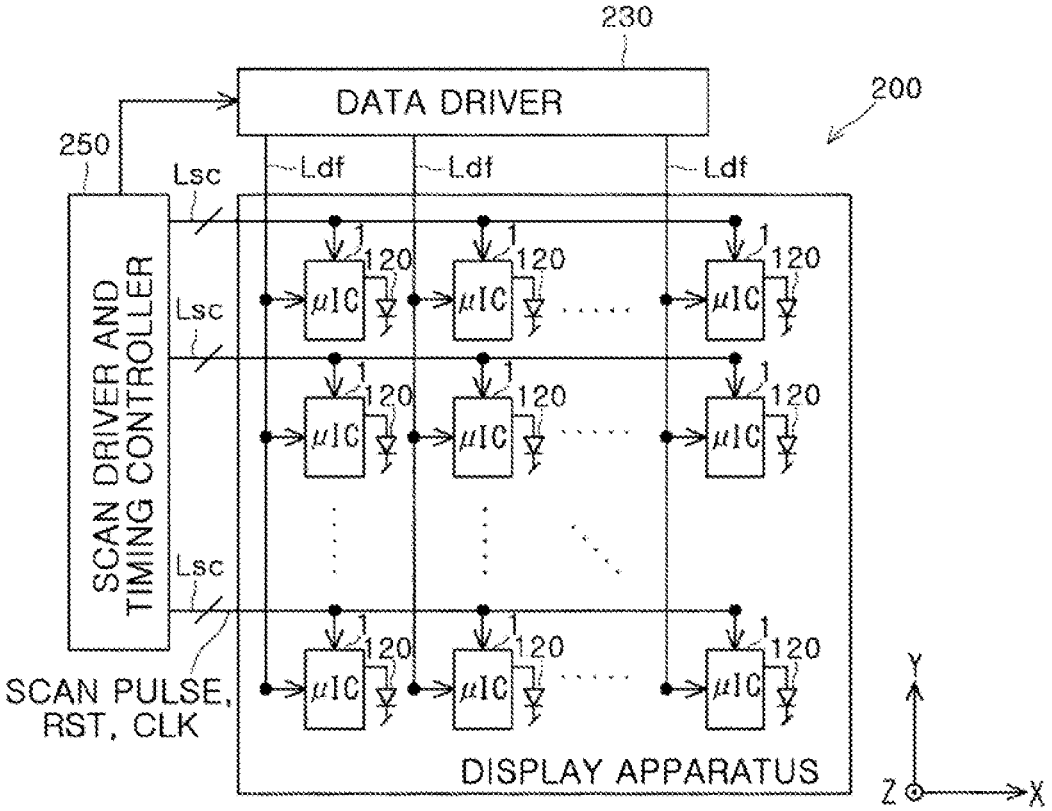
FIG. 24 is a diagram illustrating a display apparatus according to an embodiment.

FIG. 24 is a view illustrating a display apparatus according to an embodiment. As illustrated in FIG. 24, the display apparatus 200 may include a plurality of micro ICs 1 and a plurality of light emitting elements 120. The display apparatus 200 may also include a scan driver and timing controller 250 and a data driver 230. In the display apparatus 100, the plurality of micro ICs 1 and the light emitting elements 120 are arranged in the matrix form on a display surface. For example, the plurality of micro ICs 1 and the light emitting elements 120 are arranged in a matrix arranged in an X-axis direction and a Y-axis direction when an XYZ orthogonal coordinate system having the display surface as an XY plane is used.

A plurality of scan lines Lsc may be connected to the scan driver and timing controller 250. Each scan line Lsc may be connected to the plurality of micro ICs 1 arranged in the X-axis direction. The scan driver and timing controller 250 may output a reset signal RST and a clock signal CLK to the plurality of micro ICs 1 connected to each scan line Lsc while sequentially scanning each scan line Lsc. Through this, the micro IC 1 to be driven may be selected.

A plurality of data lines Ldt may be connected to the data driver 230. Each data line Ldt may be connected to the plurality of micro ICs 1 arranged in the Y-axis direction. Through this, the data driver 230 may output the image signal to the plurality of micro ICs 1 connected to each data line Ldt.

<Micro IC>

Figure 25:
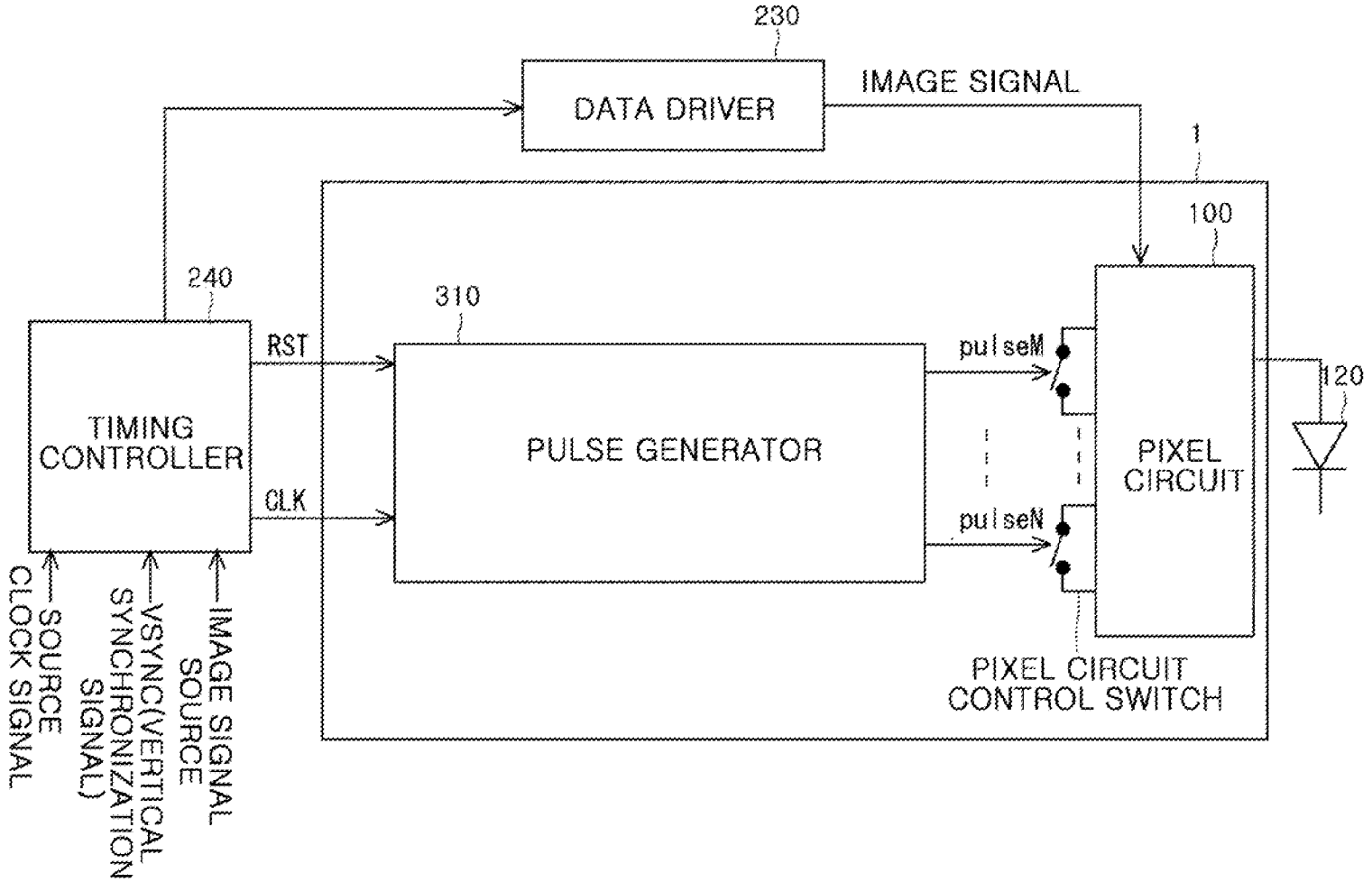
FIG. 25 is a block diagram illustrating a micro IC used in a display apparatus according to an embodiment.

FIG. 25 is a block diagram illustrating a micro IC used in a display apparatus according to an embodiment. As illustrated in FIG. 25, the timing controller 240 may output the clock signal CLK and the reset signal RST to the micro IC 1. The micro IC 1 may receive the image signal from the data driver 230 based on the clock signal CLK and the reset signal RST, and control light emission of the light emitting element 120 according to the image signal.

Here, a source clock signal, a vertical synchronization signal VSYNC, and an image signal source may be input to the timing controller 240. The timing controller 240 may scan the pixel including the micro IC 1 and the light emitting element 120 by outputting the clock signal CLK and the reset signal RST to the micro IC 1 based on the source clock signal and the vertical synchronization signal VSYNC. The timing controller 240 may output the image signal source to the data driver 230. The data driver 230 may output the image signal to the pixel circuit 100 of the selected pixel.

The micro IC 1 may include a pulse generator 310 for reducing the number of I/Os and the pixel circuit 100 for controlling light emission of the light emitting element 120.

As described above, the pixel circuit 100 may include the plurality of switches. For example, the pixel circuit 100 may include the plurality of switches 114 and 115 as illustrated in FIG. 3.

The pulse generator 310 may output pulse signals pulse(1) to pulse(n) for controlling on/off of the plurality of switches 114 and 115 of the pixel circuit 100. The pulse generator 310 is described in more detail below.

In FIG. 25, the number of pulse generator 310: pixel circuit 100: light emitting element 120 is illustrated as 1:1:1. However, this ratio is not limited to 1:1:1. That is, one pulse generator 310 may be configured to drive the plurality of pixel circuits 100 and the plurality of light emitting elements 120, or the plurality of pulse generators 310 may be configured to drive one or the plurality of pixel circuits 100 and one or the plurality of light emitting elements 120. The reset signal RST and the clock signal CLK driving the pulse generator 310 may be generated by the external timing controller 240.

The pulse generator according to the embodiment is described. First, the configuration of the pulse generator according to the embodiment will be described. Subsequently, the operation of the pulse generator is described.

<Configuration of Pulse Generator>

Figure 26:
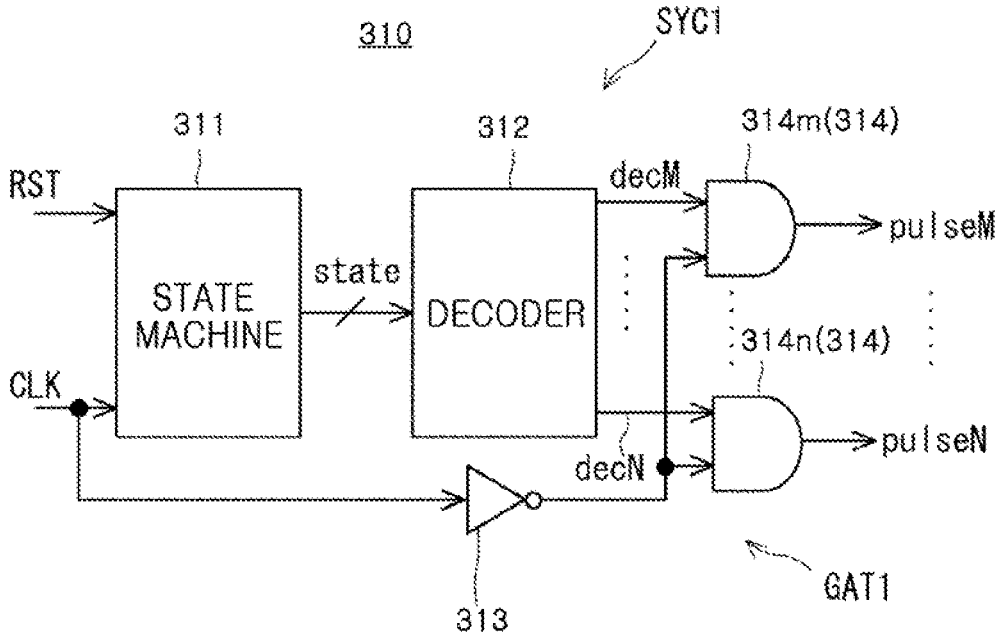
FIG. 26 is a block diagram illustrating a pulse generator according to an embodiment.

FIG. 26 is a block diagram illustrating a configuration of a pulse generator according to an embodiment. As illustrated in FIG. 26, the pulse generator 310 according to the embodiment may include a synchronous circuit SYC1 and a gating circuit GAT1. The synchronous circuit SYC1 may include a sequential circuit that is driven by the input of the clock signal CLK. In addition, the synchronous circuit SYC1 may output a plurality (e.g., n) of output signals dec(1) to dec(n) by driving the sequential circuit. On the other hand, the gating circuit GAT1 may generate the plurality of pulse signals pulse(1) to pulse(n) by gating the plurality of output signals dec(1) to dec(n) output from the synchronous circuit SYC1.

As illustrated in FIG. 26, the synchronous circuit SYC1 may include, for example, a state machine 311 to which the clock signal CLK and the reset signal RST are input as the sequential circuit. In addition, the synchronous circuit SYC1 may include a decoder 312 that outputs the plurality of output signals dec(1) to dec(n) based on a state signal (state) output from the state machine 311. The gating circuit GAT1 may include, for example, an inverter 313 and a plurality of AND gates 314(1) to 314(*n*). The plurality of AND gates 314(1) to 314(*n*) may be collectively referred to as an "AND gate 314", but when referring to a specific AND gate among the plurality of AND gates 314*m* and 314*n*, it may be referred to as an AND gate 314*m* or an AND gate 314*n*. In the following, each configuration will be described in detail.

<State Machine>

The state machine 311 may be connected to, for example, the timing controller that outputs such signals so that the clock signal CLK and the reset signal RST are input. Signals other than the clock signal CLK and the reset signal RST may be input to the state machine 311. The state machine 311 may output the state signal based on the input clock signal CLK and the reset signal RST. For example, the state machine 311 may output the state signal to the decoder 312.

The state machine 311 may include a counter as the sequential circuit therein, for example. The state machine 311 is the sequential circuit, and may include a group of D flip-flops, for example. In addition, the state machine 311 is the sequential circuit, and may include at least one of the counter, the flip-flop, a register, and a latch. The state machine 311 may output the state signal state in which the state is transitioned in synchronization with the clock signal CLK. That is, the state signal state may change from an active state to an inactive state in synchronization with the clock signal CLK, or may change from the inactive state to the active state.

<Decoder>

The decoder 312 may input the state signal output from the state machine 311. The decoder 312 may output the plurality of output signals dec(1) to dec(n) based on the input state signal state. In the drawing, two output signals decM and decN are illustrated, but the number of output signals decM and decN output from the decoder 312 is not limited to two. The number of output signals output by the decoder 312 may depend, for example, on the configuration of the pixel circuit to be driven.

The decoder 312 may basically be configured as a combination circuit. However, the decoder 312 may include the combination circuit, and may further include the sequential circuit. When the decoder 312 includes the sequential circuit, the sequential circuit may be driven with the same clock signal CLK as the clock signal CLK used in the state machine 311 to achieve the synchronous circuit.

<Inverter>

The inverter 313 may be connected to the same timing controller as the state machine 311, for example, so that the clock signal CLK is input. The inverter 313 may output an inverted signal of the input clock signal CLK. The inverter 313 may output the inverted signal to each of the AND gates 314*m* and 314*n*.

<And Gate>

The AND gates 314 may be provided in plurality in correspondence with the plurality of output signals dec(1) to dec(n). In FIG. 26, the plurality of AND gates 314 are represented as AND gates 314*m* and 314*n* in correspondence with the output signals decM and decN among the plurality of output signals dec(1) to dec(n). Here, the number of AND gates 314 is not limited to two and may vary depending on the number of output signals dec(1) to dec(n).

Each of the AND gates 314(1) to 314(*n*) may output a logical product of each of the output signals dec(1) to dec(n) output from the decoder 312 and the inverted signal of the clock CLK output from the inverter 313 as each pulse signal pulse(1) to pulse(n). In FIG. 26, two pulse signals pulseM and pulseN are illustrated, but the pulse signals pulseM and pulseN are not limited to two, and may vary depending on the number of AND gates 314.

The AND gate 314 may gate the output of the decoder 312. For example, each of the pulse signals pulse(1) to pulse(n) may be activated by the gating circuit GAT1 in a L state period of any one of the clock signals CLK. For example, each of the pulse signals pulseM and pulseN may be activated in the second half of the clock signal CLK period by the gating circuit GAT1.

The gating circuit GAT1 makes the period from the rising of the clock signal CLK to the next falling, and each of the pulse signals pulse(1) to pulse(n) in the inactive state. For example, the gating circuit GAT1 may deactivate each of the pulse signals pulse(1) to pulse(n) in the first half of the clock signal CLK period. Therefore, the output signals dec(1) to dec(n) output from the decoder 312 may be output as pulse signals pulse(1) to pulse(n) as delayed from the rising of the clock signal CLK. That is, the pulse signals pulse(1) to pulse(n) transition to the active state as if delayed from the rising of the clock signal CLK. Hereinafter, the timing of each signal will be described as the operation of the pulse generator 310.

<Operation Pulse Generator>

Figure 27:
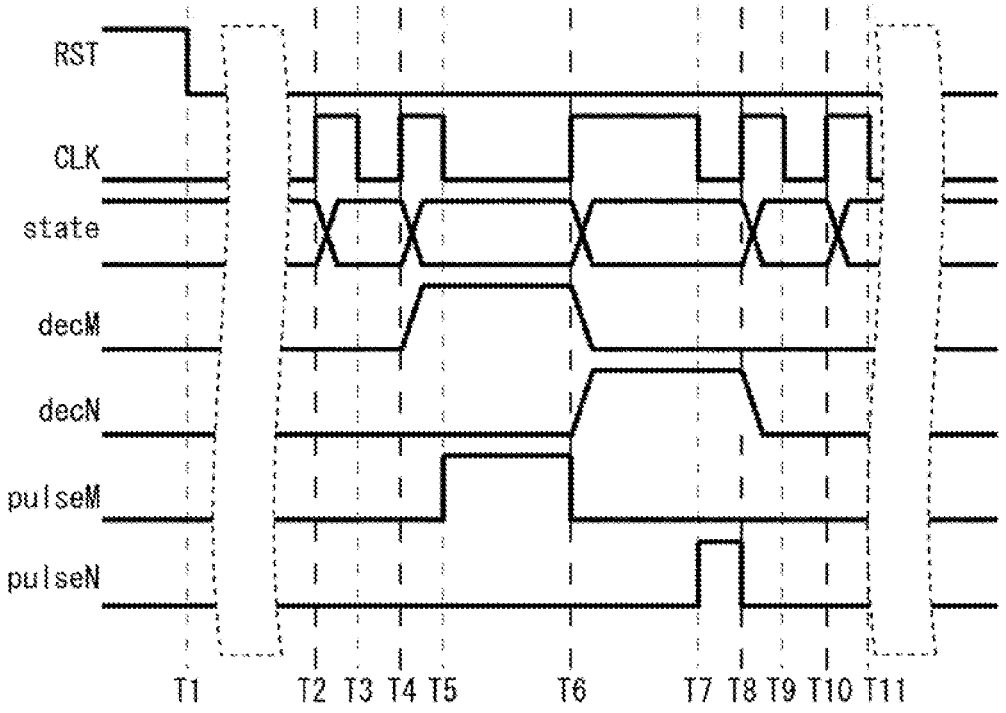
FIG. 27 is a timing diagram illustrating an operation of a pulse generator in which a horizontal axis represents time and a vertical axis represents each signal, according to an embodiment.

Next, the operation of the pulse generator 310 will be described. FIG. 27 is a timing diagram illustrating an operation of a pulse generator according to an embodiment, where a horizontal axis represents time and a vertical axis represents each signal.

As illustrated in FIG. 27, the reset signal RST and the clock signal CLK input to the state machine 311 transition to the H state and the L state at a predetermined timing. In FIG. 2, time T1<time T2<time T3<time T4<time T5<time T6<time T7<time T8<time T9<time T10<time T11. Time T2, time T4, time T6, time T8, and time T10 correspond to the rising of the clock signal CLK. The pulse generator 310 according to the embodiment illustrates an example in which the state signal transitions to a state in synchronization with the rising of the clock signal CLK.

For example, the reset signal RST is in a high state (hereinafter referred to as an H state) until time T1 in the range illustrated in FIG. 27. Through this operation, the reset signal RST may initialize the state machine 311. For example, the reset signal RST may initialize the counter to zero. The reset signal RST transitions to a low state (hereinafter, referred to as an L state) at time T1, and remains in the L state after time T1.

The clock signal CLK is in the L state until time T2. The clock signal CLK transitions to the H state at time T2. Then, the clock signal CLK transitions to the L state at time T3. Further, the clock signal CLK transitions to the H state at time T4. Then, the clock signal CLK transitions to the L state at time T5. Further, the clock signal CLK transitions to the H state at time T6. Then, the clock signal CLK transitions to the L state at time T7. The clock signal CLK transitions to the H state at time T8. Then, the clock signal CLK transitions to the L state at time T9. Also, the clock signal CLK transitions to the H state at time T10. Then, the clock signal CLK transitions to the L state at time T11. In other words, the clock signal CLK toggles at each time T1 through T11.

The period of the clock signal CLK is a period from the activation rising of the clock signal CLK to the next rising. That is, the period of the clock signal CLK refers to a period from time T2 to T4, a period from time T4 to T6, a period from time T6 to T8, and a period from time T8 to T10. In addition, a duty rate of the clock signal CLK refers to a ratio between the H state period and the L state period of the clock signal CLK. For example, it refers to the ratio of the period from time T3 to T4 to the period from time T2 to T3, the ratio of the period from time T5 to T6 to the period from time T4 to T5, the ratio of the period from time T6 to T7 to the period from time T5 to T6, the ratio of the period from time T7 to T8 to the period from time T6 to T7, and the ratio of the period from time T9 to T10 to the time period from time T8 to T9.

The period of time T5 to T6 and the period of time T6 to T7 are longer than the period of time T2 to T3, the period of time T3 to T4, the period of time T4 to T5, the period of time T7 to T8, the period of time T8 to T9, the period of time T9 to T10, and the period of time T10 to T11. That is, the period in the L state of the clock signal CLK at time T5 to T6 and the period in the H state at time T6 to T7 are longer than other periods.

In the embodiment, a cycle and the duty rate of the clock signal CLK may be changed. For example, the cycle and the duty rate of the clock signal CLK input to the state machine 311 may be changed by the timing controller. Alternatively, an optimal cycle and the duty rate may be set in the timing controller in advance. By changing the cycle and the duty rate of the clock signal CLK, the activation period of one pulse signal may be different from the activation period of other pulse signals. For example, the activation period of the pulse signal pusleM may be different from the activation period of the pulse signal pulseN.

When the pulse signal output from the pulse generator 310 is used for the switch of the pixel circuit, there are cases in which it is desired to change a period between an open state and a closed state for each switch, and an interval between the open state and the closed state. In the embodiment, since the cycle and duty rate of the clock signal CLK can be changed, it is possible to freely set the period of the switch open and close state of the pixel circuit, and the interval between the open state and the closed state.

The state machine 311 may output the state signal based on the input clock signal CLK. That is, the state transition may be performed in synchronization with the rising of the clock signal CLK.

An example of the operation when the state machine 311 is configured with the counter is as follows. Until time T2 the counter is zero. The counter transitions from time T2 to 1 in synchronization with the rising of the clock signal CLK. Further, the counter transitions from time T4 to 2 in synchronization with the rising of the clock signal CLK. Further, the counter transitions from time T6 to 3 in synchronization with the rising of the clock signal CLK. In this way, the counter increases by, for example, 1 in synchronization with the rising of the clock signal CLK.

The decoder 312 may output signals dec(1) to dec(n) according to the state signal. For example, the decoder 312 may output the output signal decM based on the state signal when the counter is 2 at time T4. That is, when a second clock signal CLK illustrated in FIG. 27 rises, the decoder 312 may activate the output signal decM to transition the output signal decM to the H state. In addition, at time T6, the decoder 312 may deactivate the output signal decM to transition the output signal decM to the L state.

Also, the decoder 312 may output an output signal decN based on the state signal in the case of counter 3 at time T6, for example. That is, when a third clock signal CLK illustrated in the drawing rises, the decoder 312 may activate the output signal decN to transition the output signal decN to the H state. At time T8, the decoder 312 may deactivate the output signal decN to transition the output signal decN to the L state.

The pulse generator 310 according to the embodiment illustrates an example in which the state signal transitions to the state in synchronization with the rising of the clock signal CLK. Accordingly, the gating circuit GAT1 may use the inverted signal of the clock signal CLK for gating. For example, the gating circuit GAT1 may use the plurality of AND gates 314(1) to 314(*n*) that output the logical product of each of the output signals dec(1) to dec(n) and the inverted signal of the clock signal CLK.

The AND gate 314*m* may output the logical product of the output signal decM output from the decoder 312 and the inverted signal of the clock signal CLK output from the inverter as the pulse signal pulseM. The AND gate 314*n* may output the logical product of the output signal decN output from the decoder 312 and the inverted signal of the clock signal CLK output from the inverter as the pulse signal pulseN.

In this case, the gating circuit GAT1 including the inverter 313 and the AND gate 314*m* may make the pulse signal pulseM in the inactive state for the period from the rising of the time T4 of the clock signal CLK to the next falling. Particularly, the gating circuit GAT1 may make the pulse signal pulseM in the inactive state for the period of time T4 to T5. In this way, the gating circuit GAT1 may deactivate the pulse signal pulseM in the first half of the clock signal CLK cycle. In addition, the pulse signal pulseM may be activated by the gating circuit GAT1 in the L state period of any one of the clock signals CLK. Particularly, the pulse signal pulseM may be activated in the period of time T5 to T6. In this way, the pulse signal pulseM may be activated in the second half of the clock signal CLK cycle.

In addition, the gating circuit GAT1 including the inverter 313 and the AND gate 314*n* may make the pulse signal pulseN in the inactive state for the period from the rising of the time T6 of the clock signal CLK to the next falling. Particularly, the gating circuit GAT1 may make the pulse signal pulseN in the inactive state for the period of time T6 to T7. In this way, the gating circuit GAT1 may deactivate the pulse signal pulseN in the first half of the clock signal CLK cycle. In addition, the pulse signal pulseN may be activated by the gating circuit GAT1 in the L state period of any one of the clock signals CLK. Particularly, the pulse signal pulseN may be activated in the period of time T7 to T8. In this way, the pulse signal pulseN may be activated in the second half of the clock signal CLK cycle.

Figure 28:
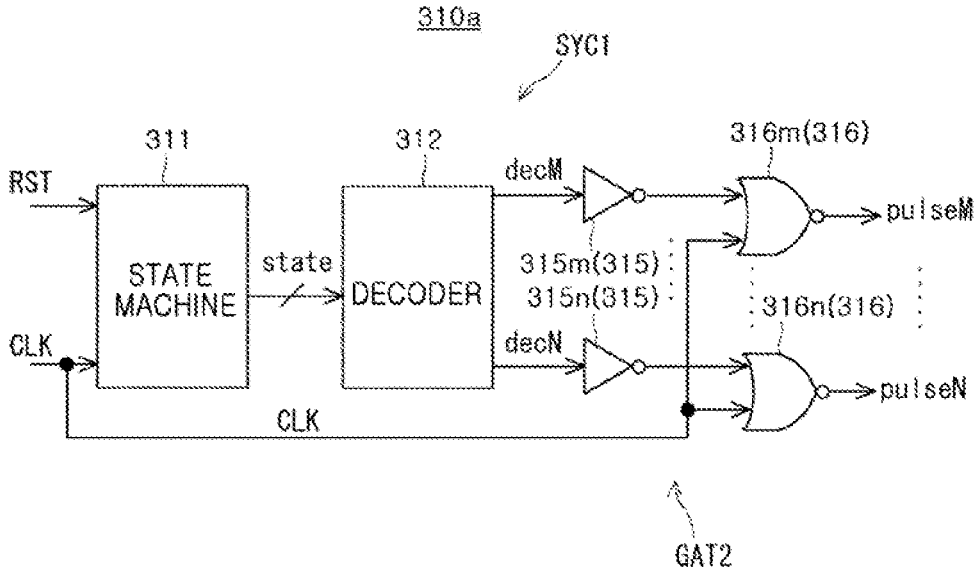
FIG. 28 is a block diagram illustrating a pulse generator according to an embodiment.

Here, the gating circuit GAT1 is not limited to the AND gate 314 and the inverter 313 illustrated in FIG. 23. FIG. 28 is a block diagram illustrating a pulse generator according to an embodiment. As illustrated in FIG. 28, a gating circuit GAT2 of a pulse generator 310*a* according to the modified embodiment may include a plurality of inverters 315 (each inverter is referred to as inverters 315(1) to 315(*n*)) that generate the inverted signal of each of the output signals dec(1) to dec(n) output from the decoder 312 and a plurality of NOR gates 316 (each NOR gate is referred to as NOR gates 316(1) to 316(*n*)) that output a negative logic sum of each inverted signal and the clock signal CLK output from the inverter 315 as each of the pulse signals pulse(1) to pulse(n).

Even in this case, the gating circuit GAT2 may make each of the pulse signals pulse(1) to pulse(n) in the inactive state for the period from the rising of the clock signal CLK to the next falling. In addition, each of the pulse signals pulse(1) to pulse(n) may be activated by the gating circuit GAT2 in any one L state period of the clock signals CLK.

In addition, the gating circuit GAT1 or GAT2 may be appropriately changed according to positive/negative logic and De Morgan's law. In addition, in the embodiment, the state machine 311 is assumed to transition to the state signal (state) in synchronization with the rising of the clock signal CLK, but the state signal (state) may be made to transition in synchronization with the falling of the clock signal CLK.

Next, the effect of the embodiment will be described.

The pulse generators 310 and 310*a* according to the embodiments may include the synchronous circuit SYC1 that outputs the plurality of output signals dec(1) to dec(n)

and the gating circuits GAT1 and GAT2 that generate the plurality of pulse signals pulse(1) to pulse(n) by gating the output signals dec(1) to dec(n). Thus, for example, pulse signals pulse(1) to pulse(n) that control on/off of the switch that controls light emission of the light emitting element may be generated inside the pulse generators 310 and 310*a*. In this case, the pulse generators 310 and 310*a* may output pulse signals pulse(1) to pulse(n) only by inputting the clock signal CLK and the reset signal RST. Accordingly, the pulse signals pulse(1) to pulse(n) may be internally generated without depending on an external input, so that an increase in circuit scale may be suppressed.

In addition, the gating circuits GAT1 and GAT2 according to the embodiment may make each of the pulse signals pulse(1) to pulse(n) in the inactive state for the period from the rising of the clock signal CLK to the next falling. For example, each of the pulse signals pulse(1) to pulse(n) may be in the inactive state in the first half of the clock signal CLK. Therefore, the plurality of pulse signals pulse(1) to pulse(n) that need to be separated on a time axis do not overlap.

Particularly, when it is necessary to separate the pulse signal pulseM and the pulse signal pulseN, the interval of time T6 to T7 may be secured between the activation period of the pulse signal pulseM and the activation period of the pulse signal pulseN. Therefore, when the pulse signal pulseM is, for example, the control signal for opening the switch SWM, and the pulse signal pulseN is, for example, the control signal for opening the switch SWN, the switch SWM is opened after the switch SWM is completely closed.

Further, in the embodiment, the pulse signal pulseM is output at count 2 of the state machine 311 and the pulse signal pulseN is output at count 3. In addition, it is gated so that the interval is secured so as to not overlap the pulse signal pulseM and the pulse signal pulseN.

For this configuration, even if the pulse signal pulseM is output at count 2 of the state machine 311, the output of two pulse signals pulseM and pulseN is stopped at count 3, and the pulse signal pulseN is output at count 4, the interval is ensured so that the pulse signal pulseM and the pulse signal pulseN do not overlap. However, in this case, a counter of twice or more times that of the embodiment is required, and the increase in the circuit scale is not suppressed.

Further, a defect may be prevented by making each of the pulse signals in the inactive state during the period from the rising of the clock signal CLK to the next falling. The defect will be described with reference to a timing diagram of a comparative example.

Figure 29:
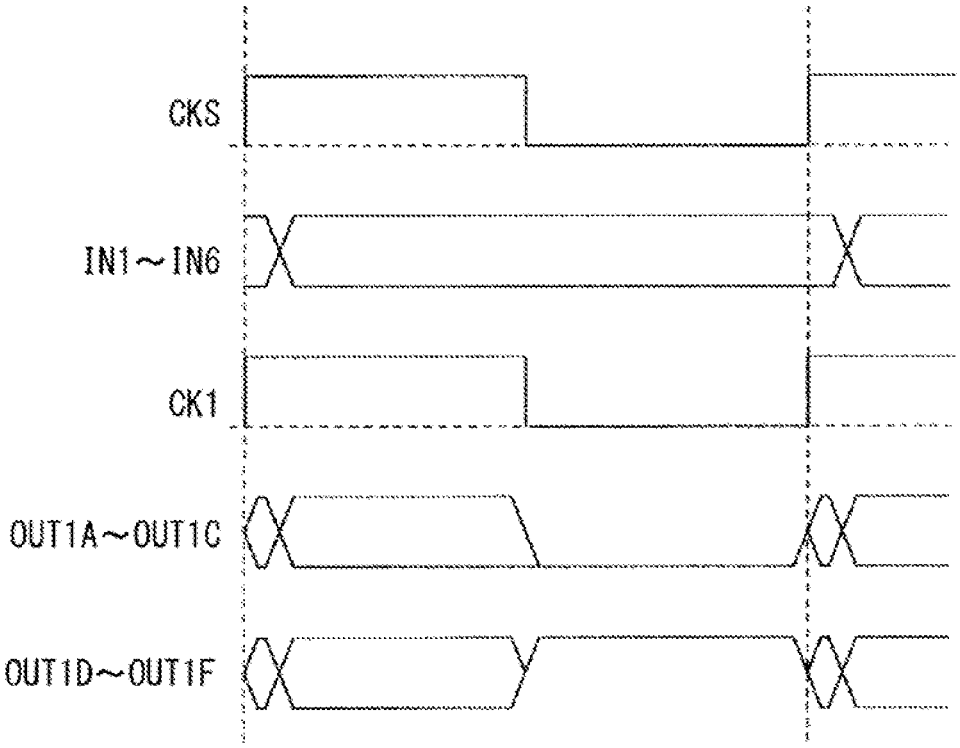
FIG. 29 is a diagram illustrating an operation of a pulse generator in which a horizontal axis represents time and a vertical axis represents each signal, according to an embodiment.

FIG. 29 is a timing diagram illustrating an operation of a pulse generator according to a comparative example, where a horizontal axis represents time and a vertical axis represents each signal.

The pulse generator of the comparative example is the pulse generator of Patent Document 2, for example. The pulse generator of the comparative example may perform gating of input data by using a clock signal CK1 of the same frequency synchronized with a sampling clock signal CKS for outputting digital data IN1 to IN6 for a logic operation. That is, when the clock signal CK1 is in either the H state or the L state, the data is forcibly set to any one of the H state/L state, and OUT1A to OUT1C or OUT1D to OUT1F are output. In the comparative example, since data is taken in the first half of the clock signal CK1 cycle, there is a risk that the defect appears in a rhombus shape and such error is taken into the data. At this time, in the comparative example, by separately preparing the clock signal at a different phase, it is possible to avoid defective output signals. However, this method does not suppress the increase in circuit scale such as providing clock signals at different phases.

On the contrary, in the embodiment, by making each of the pulse signals in the inactive state during the period from the rising of the clock signal CLK to the next falling, the defective output signal can be eliminated without providing a clock of another system.

As described above, in the embodiment, each of the output signals dec(1) to dec(n) is gated using the clock signal CLK that drives the sequential circuit, and the activation period of the pulse signals pulse(1) to pulse(n) does not overlap. The gating may use the logical product (or equivalent logic) of each of the output signals dec(1) to dec(n) and the inverted signal of the clock signal CLK. In other words, the clock signal CLK is level sensitive so that the activation periods of the pulse signals pulse(1) to pulse(n) do not overlap. Therefore, the occurrence of hazard is suppressed.

Here, the level sensitive means to output the pulse signals pulse(1) to pulse(n) only when the clock signal CLK is in the L state (in some cases, the H state). That is, it is not edge sensitive that generates pulse signals pulse(1) to pulse(n) by using the rising or falling of the clock signal CLK.

On the other hand, it is also possible to consider the case of deactivating each of the pulse signals pulse(1) to pulse(n) in the second half of the clock signal CLK, but in this case, the hazard may be included in the pulse signals pulse(1) to pulse(n), and there is a risk of malfunction. Accordingly, in the embodiment, the pulse signals pulseM and pulseN are inactive during the period from the rising of the clock signal CLK to the next falling, that is, the first half of the clock signal CLK.

In the pulse generator 310 according to the embodiment described above, although each of the pulse signals pulse(1) to pulse(n) is in the inactive state during the period from the rising of the clock signal CLK to the next falling, that is, the H state period of the clock signal CLK, the pulse generator of the embodiment may make each of the pulse signals pulse(1) to pulse(n) in the inactive state during the period from the falling of the clock signal CLK to the next rising, that is, the L state period of the clock signal CLK.

<Configuration of Pulse Generator>

Figure 30:
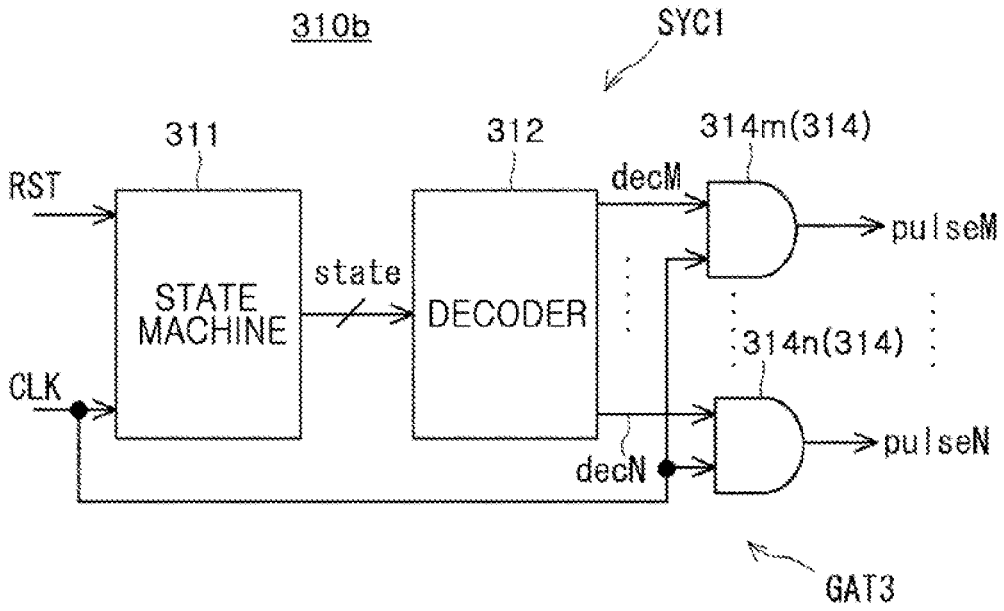
FIG. 30 is a block diagram illustrating a pulse generator according to an embodiment.

FIG. 30 is a block diagram illustrating a pulse generator according to an embodiment. As illustrated in FIG. 30, the pulse generator 310*b* may include the synchronous circuit SYC1 and a gating circuit GAT3. The synchronous circuit SYC1 may include the sequential circuit driven by the input of the clock signal CLK, similar to the embodiment. In addition, the synchronous circuit SYC1 may output the plurality (e.g., n) of output signals dec(1) to dec(n) by driving in the sequential circuit. On the other hand, the gating circuit GAT3 may gate the plurality of output signals dec(1) to dec(n) output from the synchronous circuit SYC1 to generate the plurality of pulse signals pulse(1) to pulse(n).

As illustrated in FIG. 30, the synchronous circuit SYC1 may include, for example, the state machine 311 to which the clock signal CLK and the reset signal RST are input as the sequential circuit, similar to the synchronous circuit SYC1 of the embodiment. In addition, the synchronous circuit SYC1 may include the decoder 312 that outputs the plurality of output signals dec(1) to dec(n) based on the state signal output from the state machine 311.

Unlike the gating circuit GAT1 according to the embodiment, the gating circuit GAT3 does not include the inverter 313. The gating circuit GAT3 may include the plurality of AND gates 314(1) to 314(*n*).

The functions of the state machine 311, the decoder 312, and the AND gate 314 of the pulse generator 310*b* are the same as the embodiments described above.

<Operation of Pulse Generator>

Figure 31:
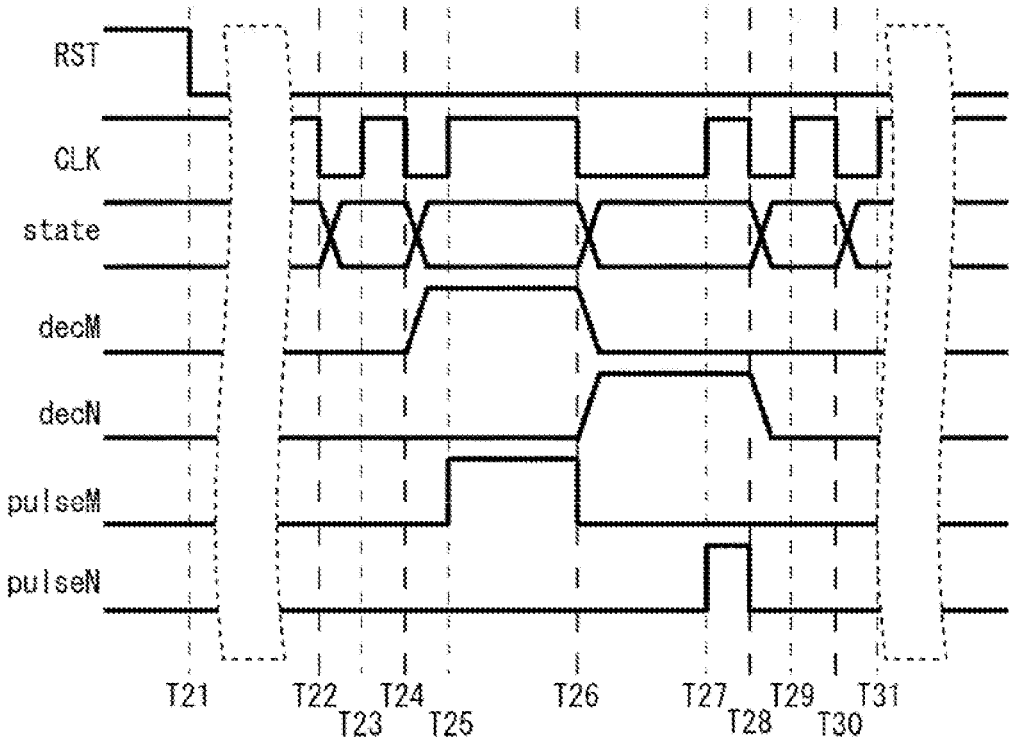
FIG. 31 is a timing diagram illustrating an operation of a pulse generator in which a horizontal axis represents time and a vertical axis represents each signal, according to an embodiment.

Next, the operation of the pulse generator 310*b* will be described. FIG. 31 is a timing diagram illustrating an operation of a pulse generator according to an embodiment, where a horizontal axis represents time and a vertical axis represents each signal.

As illustrated in FIG. 31, the reset signal RST and the clock signal CLK input to the state machine 311 transition to the H state and the L state at the predetermined timing. In FIG. 31, time T21<time T22<time T23<time T24<time T25<time T26<time T27<time T28<time T29<time T30<time T31. Time T22, time T24, time T26, time T28, and time T30 correspond to the falling of the clock signal CLK. The pulse generator 310*b* according to the embodiment illustrates an example in which the state signal transitions to the state in synchronization with the falling of the clock signal CLK.

For example, the reset signal RST is in the H state until time T21 in the range illustrated in the drawing. The reset signal RST transitions to the L state at time T21. The reset signal RST is in the L state in the range indicated in the drawing after time T21.

The clock signal CLK is in the H state until time T22 in the range illustrated in FIG. 31. The clock signal CLK transitions to the L state at time T22. Then, the clock signal CLK transitions to the H state at time T23. Further, the clock signal CLK transitions to the L state at time T24. Then, the clock signal CLK transitions to the H state at time T25. Further, the clock signal CLK transitions to the L state at time T26. Then, the clock signal CLK transitions to the H state at time T27. Further, the clock signal CLK transitions to the L state at time T28. Then, the clock signal CLK transitions to the H state at time T29. Also, the clock signal CLK transitions to the L state at time T30. Then, the clock signal CLK transitions to the H state at time T31.

The cycle of the clock signal CLK is a period from the falling of the clock signal CLK to the next falling. As in the embodiment, the duty rate of the clock signal CLK refers to the ratio between the H state period and the L state period of the clock signal CLK. Also in the embodiment, the cycle and the duty rate of the clock signal CLK may be changed.

The state machine 311 may output the state signal based on the input clock signal CLK. That is, the state transition may be performed in synchronization with the falling of the clock signal CLK.

The decoder 312 may output the output signals dec(1) to dec(n) according to the state signal. For example, the decoder 312 may output the output signal decM based on the state signal at time T24. Then, at time T26, the decoder 312 may deactivate the output signal decM to transition the output signal decM to the L state.

Also, the decoder 312 may output the output signal decN based on the state signal at time T26, for example. At time T28, the decoder 312 may deactivate the output signal decN to transition the output signal decN to the L state.

In the pulse generator 310*b* in FIG. 30, since the state signal state transitions in synchronization with the falling of the clock signal CLK, the gating circuit GAT3 may use the clock signal CLK for gating. For example, the gating circuit GAT3 may use the plurality of AND gates 314(1) to 314(*n*) that output the logical product of each of the output signals dec(1) to dec(n) and the clock signal CLK.

The AND gate 314*m* may output the logical product of the output signal decM output from the decoder 312 and the clock signal CLK as the pulse signal pulseM. The AND gate 314*n* may output the logical product of the output signal decN output from the decoder 312 and the clock signal CLK as the pulse signal pulseN.

In this case, the gating circuit GAT3 including the AND gate 314*m* may make the pulse signal pulseM in the inactive state during the period from the falling of the time T24 of the clock signal CLK to the next rising. Particularly, the gating circuit GAT3 may make the pulse signal pulseM inactive for the period of time T24 to T25. In this way, the gating circuit GAT3 may deactivate the pulse signal pulseM in the first half of the clock signal CLK cycle. In addition, the pulse signal pulseM may be activated in the H state period of any one of the clock signals CLK by the gating circuit GAT3. Particularly, the pulse signal pulseM may be activated in the period of time T25 to T26. As such, the pulse signal pulseM may be activated in the second half of the clock signal CLK cycle.

In addition, the gating circuit GAT3 including the AND gate 314*n* may make the pulse signal pulseN in the inactive state during the period from the falling of the time T26 of the clock signal CLK to the next rising. Particularly, the gating circuit GAT3 may make the pulse signal pulseN inactive for the period of time T26 to T27. As such, the gating circuit GAT3 may deactivate the pulse signal pulseN in the first half of the clock signal CLK cycle. In addition, the pulse signal pulseN may be activated in the H state period of any one of the clock signals CLK by the gating circuit GAT3. Particularly, the pulse signal pulseN may be activated in the period of time T27 to T28. In this way, the pulse signal pulseN may be activated in the second half of the clock signal CLK cycle.

Figure 32:
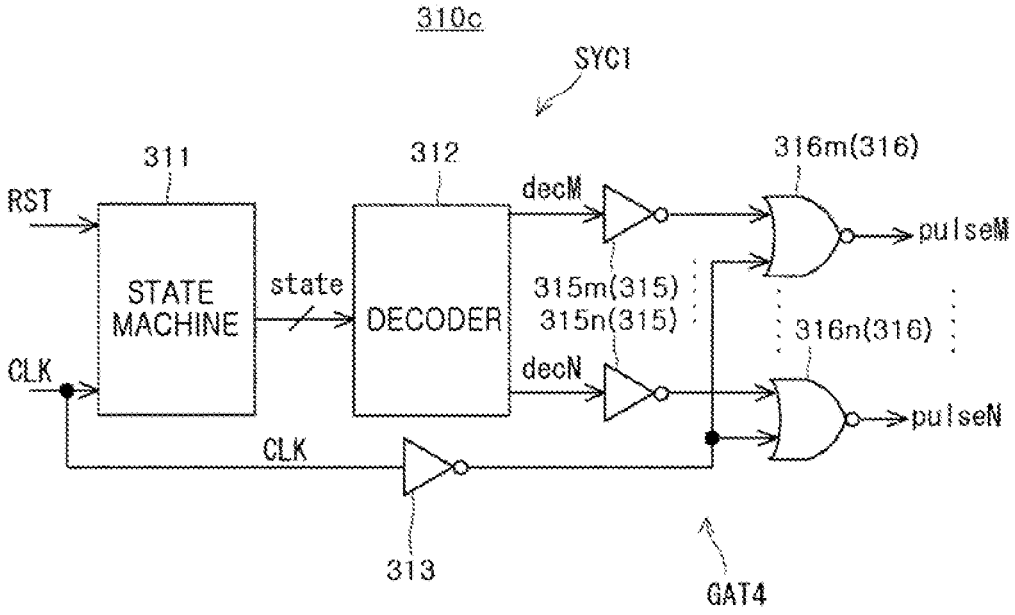
FIG. 32 is a block diagram illustrating a pulse generator according to an embodiment.

Here, the gating circuit GAT3 is not limited to the AND gate 314 illustrated in FIG. 30. FIG. 32 is a block diagram illustrating a pulse generator according to an embodiment. As illustrated in FIG. 32, the gating circuit GAT4 of the pulse generator 310*c* according to this embodiment may include inverters 315 that outputs the inverted signal of the clock signal CLK, the plurality of inverters 315 that generate the inverted signal of each of the output signals dec(1) to dec(n) output from the decoder 312, and the plurality of NOR gates 316 that output a negative OR of the inverted signal output from the inverter 315(1) and the inverted signal output from the inverter 315(*n*) as each of the pulse signals pulse(1) to pulse(n).

Even in this case, the gating circuit GAT4 may make each of the pulse signals pulse(1) to pulse(n) inactive during the period from the falling of the clock signal CLK to the next rising. In addition, each of the pulse signals pulse(1) to pulse(n) may be activated by the gating circuit GAT4 in any one H state period of the clock signals CLK.

Further, the gating circuit GAT3 or GAT4 may be appropriately changed according to positive/negative logic, De Morgan's law, and the like, as in the embodiment.

Also, in the pulse generators 310*b* and 310*c* described above, the pulse signals pulse(1) to pulse(n) may be generated inside the pulse generators 10*b* and 10*c* without depending on the external input. Thus, the increase in the circuit scale may be suppressed.

In addition, the gating circuits GAT3 and GAT4 according to the embodiment may make each of the pulse signals pulse(1) to pulse(n) in the inactive state even during the period from the falling of the clock signal CLK to the next rising. Accordingly, the pulse generators 10*b* and 10*c* may deactivate each of the pulse signals pulse(1) to pulse(n) in the L state period of the clock signal CLK, thereby improving the degree of freedom in circuit configuration.

Accordingly, in the display apparatus 200, various pulse signals pulseM and pulseN may be generated inside the micro IC 1 from the clock signal CLK generated by the timing controller 240. Here, the number of signal lines connecting the timing controller 240 and the pixel circuit 100 is reduced.

The display apparatus 200 provides the synchronous circuit SYC1 and the gating circuit GAT1 in the micro IC 1 to generate the signal for controlling the switch of the pixel circuit 100. Accordingly, the number of signals input/output to the micro IC 1 is reduced. For example, when the timing controller controls the plurality of switches of the pixel circuit, as in a conventional display apparatus, it is necessary to supply all signals to the pixel circuit from the timing controller. Therefore, the increase in the number of I/Os of the micro IC 1 is inevitable. On the other hand, in the embodiment, since the pulse signals pulse(1) to pulse(n) that control the switch of the pixel circuit 100 are generated by the synchronous circuit SYC1 and the gating circuit GAT1, it is sufficient if the reset signal RST and the clock signal CLK are provided as the input/output signals I/O.

As described above, the clock signal CLK may dynamically change its cycle or duty rate. Here, "dynamic" means mixing various cycle duty rates within one frame period when driving the display apparatus. Therefore, when adjustment of the driving timing is not required, the clock signal CLK may be realized by a hard code, that is, a fixed circuit in the timing controller 240, and a change device capable of adjusting timing in the future may be provided.

In other words, the cycle and duty rate of the clock signal CLK may be dynamically changed at a constant cycle and a 50% duty rate for one frame period. Accordingly, various timing adjustments may be realized only by controlling the clock signal CLK. Other configurations, operations, and effects may be included in the description of the embodiment.

In an embodiment, a display apparatus may include a display matrix; a data driver; and a timing controller. The display matrix may include a light emitting element and a micro IC configured to drive the light emitting element. The micro IC may include a pixel circuit that continuously receives an image signal and a slope signal from the data driver through a data line, and to drive the light emitting element based on a comparison between the image signal and the slope signal; and a pulse generator configured to receive the reset signal and the clock signal from the timing controller through a scan line, and to provide a pulse signal for controlling an operation timing of the pixel circuit based on the clock signal to the pixel circuit.

In an embodiment, a display apparatus may include a light emitting element; and a micro IC configured to drive the light emitting element. The micro IC may include a first capacitor configured to output a first voltage corresponding to an image signal; a first transistor connected to the first capacitor and having a control terminal to which the first voltage is applied, a first terminal to which a second voltage corresponding to a slope signal that changes over time is applied, and a second terminal configured to output an output signal based on a comparison between the first voltage and the second voltage; a first switch provided between the control terminal and the second terminal of the first transistor, configured to connect or block the control terminal and the second terminal; a second switch provided between the second terminal of the first transistor and an external power terminal; a pulse generator configured to control the first switch and the second switch based on a reset signal and a clock signal; and a driving circuit configured to drive the light emitting element based on the output signal of the second terminal.

The pixel circuit may include a transistor having a light emitting element, a control terminal configured to input an image signal, a first terminal configured to input a slope signal, and a second terminal configured to output a comparison result of the image signal and the slope signal; and a driving circuit configured to drive the light emitting element according to the comparison result.

In an embodiment, a display apparatus may include a display matrix device in which a plurality of pixel circuits are arranged in a matrix form; and a driving controller configured to control driving of the plurality of pixel circuits. The pixel circuit may include a transistor having a light emitting element, a control terminal configured to input an image signal, a first terminal configured to input a slope signal, and a second terminal configured to output a comparison result of the image signal and the slope signal; and a driving circuit configured to drive the light emitting element according to the comparison result.

In an embodiment, a method of driving a display apparatus may include inputting an image signal to a control terminal of a gradation control transistor; inputting a slope signal to a first terminal of the gradation control transistor; outputting a comparison result of the image signal and the slope signal from a second terminal of the gradation control transistor; and driving a light emitting element according to the comparison result.

The pulse generator may include a synchronous circuit including a sequential circuit driven by input of a clock signal, configured to output a plurality of output signals by driving the sequential circuit; and a gating circuit configured to generate a plurality of pulse signals by gating the plurality of output signals output from the synchronous circuit. The gating circuit may be configured to deactivate each of the pulse signals in a high state period of the clock signal.

The each of the pulse signals may be configured to be activated by the gating circuit in a low state period of any one of the clock signals.

The synchronous circuit is the sequential circuit, and may include a state machine configured to input the clock signal; and a decoder configured to output the plurality of output signals based on state signals output from the state machine.

The gating circuit may include an inverter configured to output an inverted signal of the clock signal; and a plurality of AND gates configured to output a logical product of each of the output signals output from the decoder and the inverted signal output from the inverter as each of the pulse signals.

In addition, the gating circuit may include an inverter configured to output an inverted signal of each of the output signals output from the decoder, and a plurality of NOR gates configured to output a negative logical sum of the inverted signal output from the inverter and the clock signal as the pulse signal, respectively.

In addition, the state machine may include at least one of a counter, a register, a flip-flop, and a latch.

The decoder includes a combination circuit.

In addition, the decoder may further include a sequential circuit.

In addition, by changing a duty rate of the clock signal or a cycle representing the period from the rising of the activation of the clock signal to the next rising, an activation period of one pulse signal is different from the other pulse signal activation periods.

In the display apparatus, a plurality of micro ICs including the above-described pulse generator and the pixel circuit for controlling light emission of the light emitting element based on the pulse signal are arranged in a matrix form on a display surface.

The embodiments of the disclosure are not limited to the above specific embodiments, and may be modified, replaced, or improved without departing from the spirit of the disclosure. For example, the P-type MOS transistor may be used as the N-type MOS transistor or the N-type MOS transistor may be used as the P-type MOS transistor. It is not limited to MOS transistors, and other transistors may be used.

According to the embodiments of the disclosure, the dynamic range may be expanded.

According to the embodiments of the disclosure, it is possible to provide the pulse generator and the display apparatus for suppressing the increase in circuit scale and preventing the activation periods of the plurality of digital pulses from overlapping.

Although specific embodiments have been illustrated and described, it will be appreciated by those skilled in the art that modification, replacement and improvement may be made to these embodiments without departing from the principles and spirit of the disclosure, the scope of which is defined in the claims and their equivalents.

What is claimed is:

1. A display apparatus comprising:

a light emitting element; and a pixel circuit configured to drive the light emitting element, wherein the pixel circuit comprises:

a first capacitor configured to output a first voltage corresponding to an image signal;

a first transistor comprising:

a control terminal connected to the first capacitor and to which the first voltage is applied;

a first terminal to which a second voltage corresponding to a slope signal that changes over time is applied; and a second terminal configured to output an output signal based on a comparison between the first voltage and the second voltage;

a driving circuit configured to drive the light emitting element based on the output signal of the second terminal; and an amplifier configured to amplify the output signal of the second terminal, and wherein the driving circuit is further configured to turn on or off the light emitting element based on the output signal amplified by the amplifier.

2. The display apparatus according to claim 1, wherein the amplifier is configured to make an output terminal configured to carry the output signal of the amplifier into a high impedance based on a third voltage of the output signal of the first transistor being less than a first threshold, and to amplify the third voltage of the output signal of the first transistor based on the third voltage of the output signal of the first transistor being greater than a second threshold.

3. The display apparatus according to claim 1, wherein the amplifier is configured to invert and amplify the output signal of the first transistor.

4. The display apparatus according to claim 1, wherein the driving circuit comprises:

a second transistor configured to supply a constant current to the light emitting element and a second capacitor connected to a control terminal of the second transistor, and wherein the second capacitor is configured to be charged with a reference voltage so that the second transistor supplies the constant current.

5. The display apparatus according to claim 4, wherein, based on the first voltage being less than the second voltage, the second capacitor is configured to output the reference voltage and the second transistor is configured to supply the constant current to the light emitting element, and wherein, based on the first voltage being greater than the second voltage, the second capacitor is configured to be discharged and the second transistor is configured to be turned off.

6. The display apparatus according to claim 1, wherein the pixel circuit further comprises a first switch provided between the control terminal of the first transistor and the second terminal of the first transistor, and configured to control the first switch to connect or disconnect the control terminal and the second terminal.

7. The display apparatus according to claim 6, wherein, based on the first switch being turned on to connect the control terminal and the second terminal, the image signal input through the first terminal of the first transistor is provided to the first capacitor through the first transistor.

8. The display apparatus according to claim 6, wherein the pixel circuit further comprises a second switch provided between the second terminal of the first transistor and an external power terminal.

9. The display apparatus according to claim 8, wherein the output signal output through the second terminal of the first transistor is initialized based on the second switch being turned on to connect the second terminal of the first transistor and the external power terminal.

10. The display apparatus according to claim 8, further comprising:

a pulse generator configured to control the first switch and the second switch based on a reset signal and a clock signal.

11. The display apparatus according to claim 10, wherein the pulse generator comprises:

a synchronous circuit including a sequential circuit driven by the clock signal, and configured to output a plurality of output signals from the sequential circuit; and a gating circuit configured to generate a plurality of pulse signals by gating the plurality of output signals output from the synchronous circuit, and wherein the gating circuit is configured to deactivate each pulse signal of the plurality of the pulse signals in a high state period of the clock signal.

12. The display apparatus according to claim 11, wherein the each pulse signal of the plurality of pulse signals is configured to be activated by the gating circuit in a low state period of the clock signal.

13. The display apparatus according to claim 11, wherein the sequential circuit comprises:

a state machine configured to receive the clock signal; and a decoder configured to output the plurality of output signals based on state signals output from the state machine.

14. The display apparatus according to claim 13, wherein the gating circuit comprises:

an inverter configured to output an inverted signal of the clock signal; and a plurality of AND gates configured to output the plurality of pulse signals, respectively, where each of the plurality of pulse signals includes a logical product of each of the plurality of output signals output from the decoder and the inverted signal output from the inverter.

15. The display apparatus according to claim 10, wherein the pixel circuit and the pulse generator are integrated into a micro integrated circuit (IC).

16. The display apparatus according to claim 15, wherein the micro IC comprises three or less data input terminals.

17. The display apparatus according to claim 16, wherein the three or less data input terminals comprise:

a first data input terminal configured to receive the image signal and the slope signal;

a second data input terminal configured to receive the reset signal; and a third data input terminal configured to receive the clock signal.

* * * * *